US011260675B2

(12) United States Patent
Asamoto et al.

(10) Patent No.: US 11,260,675 B2
(45) Date of Patent: Mar. 1, 2022

(54) LIQUID DISCHARGE APPARATUS AND METHOD FOR CONTROLLING LIQUID DISCHARGE APPARATUS

(71) Applicant: SEIKO EPSON CORPORATION, Tokyo (JP)

(72) Inventors: Katsuya Asamoto, Matsumoto (JP); Tsuneyuki Sasaki, Matsumoto (JP); Takehito Washizawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 128 days.

(21) Appl. No.: 16/828,639

(22) Filed: Mar. 24, 2020

(65) Prior Publication Data

US 2020/0307185 A1 Oct. 1, 2020

(30) Foreign Application Priority Data

Mar. 26, 2019 (JP) ..... JP2019-057888

(51) Int. Cl.

| | |
|---|---|
| ***B41J 2/045*** | (2006.01) |
| ***B65H 43/04*** | (2006.01) |
| ***B41J 2/05*** | (2006.01) |
| ***B41J 11/00*** | (2006.01) |

(52) U.S. Cl.

CPC ..... *B41J 11/002* (2013.01); *B41J 2/04508* (2013.01); *B41J 2/04563* (2013.01); *B41J 2/04566* (2013.01); *B41J 2/05* (2013.01); *B41J 11/0021* (2021.01); *B41J 11/0022* (2021.01); *B41J 11/00244* (2021.01); *B65H 43/04* (2013.01); *B65H 2515/805* (2013.01); *B65H 2515/83* (2013.01); *B65H 2515/842* (2013.01)

(58) Field of Classification Search

CPC ..... B41J 2/04566; B41J 2/04508; B41J 2/04563; B41J 2/05; B65H 43/04; B65H 2515/805; B65H 2515/83; B65H 2515/842

See application file for complete search history.

(56) References Cited

U.S. PATENT DOCUMENTS

| | | | | |
|---|---|---|---|---|
| 9,527,323 | B2 * | 12/2016 | Tsubota | B41J 29/377 |
| 2008/0238982 | A1 | 10/2008 | Kaneko et al. | |
| 2011/0109710 | A1 * | 5/2011 | Miyakoshi | B41J 11/0015 347/104 |

FOREIGN PATENT DOCUMENTS

| | | |
|---|---|---|
| JP | 2008-310123 | 12/2008 |
| JP | 5098790 | 12/2012 |
| JP | 2015-178179 | 10/2015 |

* cited by examiner

*Primary Examiner* — Thinh H Nguyen
(74) *Attorney, Agent, or Firm* — Workman Nydegger

(57) ABSTRACT

A liquid discharge apparatus is provided that includes a transport unit configured to transport a medium, a discharge unit configured to discharge a liquid onto the medium, a housing including therein the discharge unit, a humidifying unit configured to humidify an interior of the housing, and a humidity detection unit configured to detect a humidity. When the humidity detection unit detected a humidity less than a lower limit value (one example of a first predetermined value) (positive determination in step S12), the interior of the housing is humidified by the humidifying unit during transport by the transport unit or during discharge by the discharge unit (step S16).

8 Claims, 6 Drawing Sheets

LIQUID DISCHARGE APPARATUS AND METHOD FOR CONTROLLING LIQUID DISCHARGE APPARATUS

The present application is based on, and claims priority from JP Application Serial Number 2019-057888, filed Mar. 26, 2019, the disclosure of which is hereby incorporated by reference herein in its entirety.

BACKGROUND

1. Technical Field

The present disclosure relates to a liquid discharge apparatus including a discharge unit configured to discharge a liquid such as ink onto a medium such as a paper, and a method for controlling the liquid discharge apparatus.

2. Related Art

For example, JP 2015-178179 A discloses a liquid injection apparatus such as an inkjet printer configured to discharge a liquid such as ink onto a medium such as a paper to perform printing. The liquid injection apparatus, while sending environmental information containing temperature and humidity to a server, receives, from the server, a first estimation model for estimating a recommended time for checking nozzles generated by the server. The liquid injection apparatus computes a recommended time based on the first estimation model, performs nozzle checking at the recommended time, and urges the user to perform cleaning. Thereafter, when the user does not perform cleaning within a predetermined preliminary period, the liquid injection apparatus forcibly performs cleaning.

Unfortunately, the liquid injection apparatus described in JP 2015-178179, when the recommended time is reached, causes the user to perform cleaning by a manual operation, or the liquid discharge apparatus forcibly performs cleaning after the subsequent preliminary period passes, and thus, the frequency of performing the cleaning is left to the environment at that time. For example, when the humidity becomes low, foreign substances such as dust and fluff become easily suspended in the air. An air containing the foreign substances suspended in the air, when taken into the housing, facilitates the occurrence of nozzle clogging in the discharge unit. In this case, the recommended time calculated based on the first estimation is advanced, and thus the frequency of the cleaning increases. A higher cleaning frequency leads to increased consumption of liquid such as ink that is not utilized for printing, and reduced productivity.

Further, the liquid injection apparatus described in JP 2015-178179 A is only directed to the printing failure due to nozzles, and there is no consideration for the printing failure due to medium postures such as wrinkles and floating of a medium, which easily occur when the humidity is excessively high. Accordingly, the occurrence of printing failure due to the occurrence of wrinkles or the like in the medium cannot be suppressed. The liquid injection apparatus described in JP 2015-178179 A, when the humidity deviates from a suitable range, cannot suppress nozzle clogging or irregular posture such as wrinkles of the medium, which may occur due to the deviation. When the humidity deviates from a suitable range as such, an issue is raised in that the failure cause of disqualifying the products such as a printed material cannot be suppressed from occurring.

SUMMARY

A liquid discharge apparatus for resolving the above-described issue includes a transport unit configured to transport a medium, a discharge unit configured to discharge a liquid to the medium, a housing including therein the discharge unit, a humidifying unit configured to humidify an interior of the housing, and a humidity detection unit configured to detect a humidity, wherein when the humidity detection unit detected a humidity less than a first predetermined value, the interior of the housing is humidified by the humidifying unit during transport by the transport unit or during discharge by the discharge unit.

A liquid discharge apparatus for resolving the above-described issue includes a transport unit configured to transport a medium, a discharge unit configured to discharge a liquid to the medium, a support portion configured to support a portion of the medium, the liquid being discharged from the discharge unit onto portion of the medium, a housing including therein the discharge unit, a heating unit configured to heat the medium to which the liquid is discharged from the discharge unit, and a humidity detection unit configured to detect a humidity, wherein when the humidity detection unit detected a humidity exceeding a fourth predetermined value and when a liquid amount per unit area of the liquid discharged from the discharge unit is less than a fifth predetermined value, the temperature of the heating unit is lowered during transport by the transport unit or during discharge by the discharge unit.

A method for controlling a liquid discharge apparatus for resolving the above-described issue is a method for controlling the liquid discharge apparatus including a transport unit configured to transport a medium, a discharge unit configured to discharge a liquid onto the medium, a housing including therein the discharge unit, a humidifying unit configured to humidify an interior of the housing, and a humidity detection unit configured to detect a humidity, the method including a humidity detection step for detecting a humidity, and a humidification step for, when the humidity detection unit detects a humidity less than a first predetermined value, humidifying the interior of the housing by the humidifying unit during transport of the transport unit or during discharge of the discharge unit.

A method for controlling a liquid discharging device for resolving the above-described issue is a method for controlling the liquid discharge apparatus including a transport unit configured to transport a medium, a discharge unit configured to discharge a liquid onto the medium, a housing including therein the discharge unit, a heating unit configured to heat the medium onto which the liquid is discharged from the discharge unit, and a humidity detection unit configured to detect a humidity, the method including a first determination step for determining whether the humidity detection unit detected a humidity exceeding a fourth predetermined value, a second determination step for determining whether a liquid amount per unit area of the liquid discharged from the discharge unit is less than a fifth predetermined value, and a heating control step for, when the humidity detection unit detects a humidity exceeding the fourth predetermined value and when the liquid amount per unit area of the liquid discharged from the discharge unit is less than the fifth predetermined value, lowering a temperature of the heating unit during transport by the transport unit or during discharge by the discharge unit.

DESCRIPTION OF EXEMPLARY EMBODIMENTS

Hereinafter, a liquid discharge apparatus according to one embodiment will be described with reference to the accompanying drawings.

Figure 1:
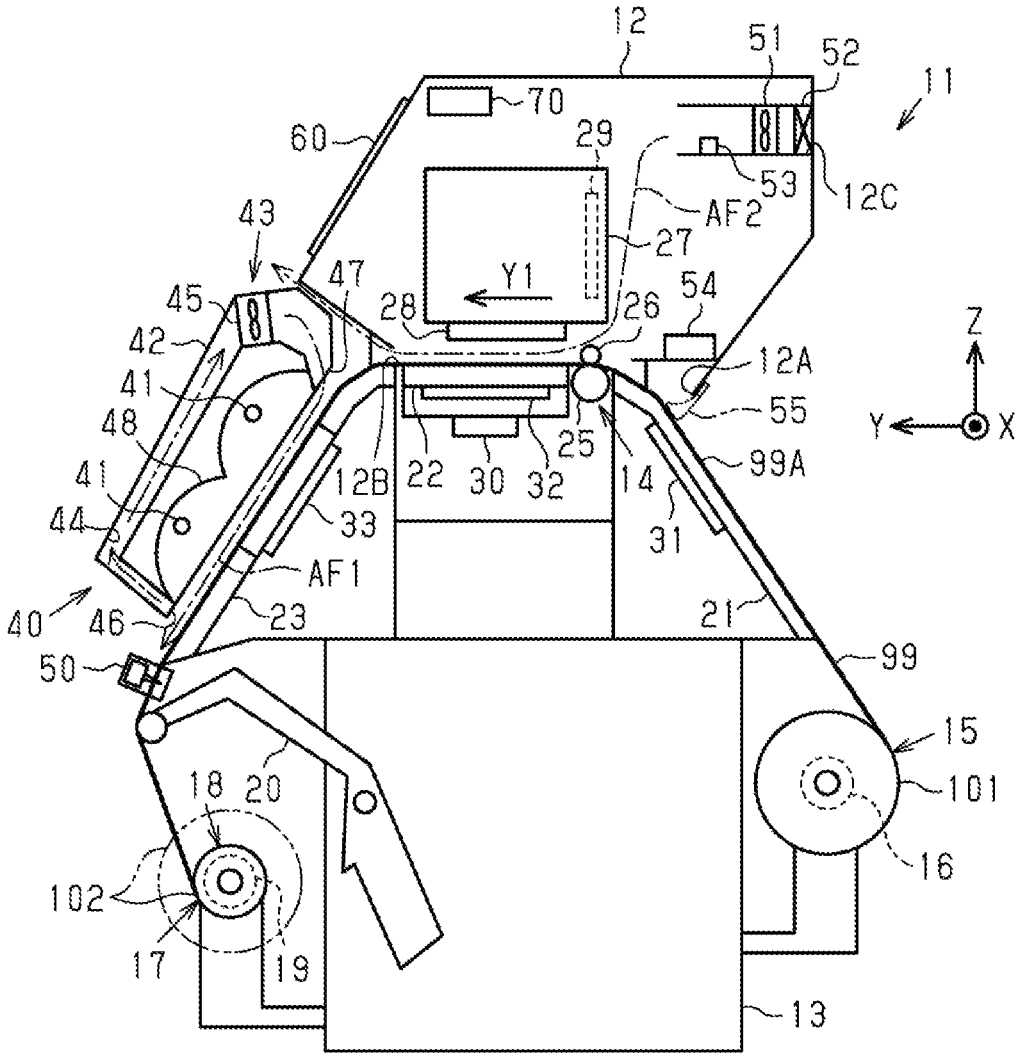
FIG. 1 is a cross-sectional view schematically illustrating a liquid discharge apparatus according to one embodiment.

A liquid discharge apparatus 11 illustrated in FIG. 1 is, for example, an inkjet-type printer that performs printing of an image such as characters and pictures on a medium such as a paper by discharging liquid such as ink. The liquid discharge apparatus 11 includes a housing 12 and a base stage 13 for supporting the housing 12. The housing 12 is an external packaging of the liquid discharge apparatus 11 that includes an openable and closable cover (not illustrated). Note that in FIG. 1 and the like, three virtual axes orthogonal to one another are referred to as X axis, Y axis, and Z axis, assuming that the liquid discharge apparatus 11 is placed on a horizontal surface. The X axis is a virtual axis parallel to the scanning direction of a discharge unit 28 that will be described later, and the Y-axis is a virtual axis parallel to the transport direction of a medium 99 in the printing region. Further, the Z-axis is a virtual axis parallel to the vertical direction.

The liquid discharge apparatus 11 includes a transport unit 14 configured to transport the medium 99. The transport unit 14 is provided inside the housing 12, and is configured to transport the medium 99 along a predetermined transport path. The liquid discharge apparatus 11 includes a feeding unit 15 configured to support a roll body 101 that the medium 99 to which a liquid is to be discharged is wound a plurality of times. The feeding unit 15 is attached to the base stage 13, for example, and supports the roll body 101 in a rotatable state. The feeding unit 15 includes a feeding motor 16 that is driven when the roll body 101 is rotated in the feeding direction. The transport unit 14 is configured to transport the medium 99 in an elongated form, which the feeding unit 15 fed out from the roll body 101.

The liquid discharge apparatus 11 includes the discharge unit 28 configured to discharge a liquid onto the medium 99. The liquid discharge apparatus 11 of this example is a serial printer in which the discharge unit 28 scans with respect to the medium 99. Accordingly, the discharge unit 28 is provided at the lower portion of a carriage 27 configured to move. The discharge unit 28 is an inkjet-type recording head. The region where the discharge unit 28 can discharge a liquid onto the medium 99 is referred to as printing region, where the direction in which the medium 99 is transported in the printing region is referred to as transport direction Y1. The carriage 27 reciprocatively moves along the X axis intersecting the transport direction Y1 of the medium 99, with respect to the medium 99 being transported. The discharge unit 28, during the movement of the carriage 27, discharges a liquid onto the medium 99 to cause an image and the like to be printed on the medium. The liquid discharge apparatus 11 includes the discharge unit 28 and the carriage 27 inside the housing 12. Note that the liquid discharge apparatus 11 may be a line printer in which the discharge units 28 are arranged in an elongated form that can discharge a liquid in the range across the width of the medium 99, which does not include the carriage 27.

As illustrated in FIG. 1, the liquid discharge apparatus 11 includes a winding unit 17 configured to wind the medium 99, to which a liquid is discharged from the discharge unit 28, in a rolled form. The winding unit 17 is attached to, for example, the base stage 13. The winding unit 17 includes a reel mechanism 18 configured to wind the medium 99 on which printing is performed by the discharge of liquid, as a roll body 102. The reel mechanism 18 includes a winding motor 19 that is driven when winding the roll body 102.

The liquid discharge apparatus 11 includes a tension bar 20 that applies tension to the medium 99. The tension bar 20 applies tension to the medium 99 by coming into contact with the medium 99. Applying tension to the medium 99 with the tension bar 20 improves the transport accuracy of the medium 99. The tension bar 20 comes in contact with, in the medium 99, a portion that passed through a drying device 40 and a portion before being wound around the winding unit 17. The tension bar 20 is attached to, for example, the base stage 13 in a pivotable manner. The tension bar 20, by changing the weight provided on the opposite side of the pivot fulcrum, can adjust the magnitude of the tension exerted on the medium 99.

The liquid discharge apparatus 11 includes an upstream support portion 21, a support portion 22, and a downstream support portion 23 that constitute the transport path of the medium 99. The upstream support portion 21, the support portion 22, and the downstream support portion 23 support the medium 99 being transported by the transport unit 14. The upstream support portion 21, the support portion 22, and the downstream support portion 23 are arranged in that order from the upstream to the downstream of the transport path. The support portion 22 is a platen for supporting a portion of the medium 99 to which a liquid is discharged by the discharge of the discharge unit 28. The support portion 22 is located inside the housing 12. Specifically, the upstream support portion 21, which configures the upstream portion of the transport path, supports the medium 99 at the portion from the feeding unit 15 to the transport unit 14. The support portion 22, which configures the middle stream portion of the transport path, supports the medium 99 at the portion downstream of the transport unit 14, which faces the discharge unit 28. The downstream support portion 23, which configures the downstream portion of the transport path, supports a portion, to which printing has been performed, of the medium 99 transported downstream by the transport unit 14, and to which a liquid is discharged from the discharge unit 28 adheres. In the example illustrated in FIG. 1, the support portion 22 is horizontally disposed, and the upstream support portion 21 and the downstream support portion 23, which are arranged on both sides with respect to the support portion 22 in the transport direction, are arranged in an inclined state, to thus form a mountain-shaped transport path with a flat top surface.

As illustrated in FIG. 1, the transport unit 14 includes a driving roller 25 and a driven roller 26. The driving roller 25 and the driven roller 26 transport the medium 99 by rotating in a nipping state nipping the medium 99. The driving roller 25 and the driven roller 26 are located between the upstream support portion 21 and the support portion 22 in the transport path. The driving roller 25 is configured to transport the medium 99 using a transport motor 77 (see FIG. 6) as the power source. The driving roller 25 and the driven roller 26 are composed of a pair of rollers configured to nip the medium 99. The driving roller 25 and the driven roller 26 are switched between a spaced apart state being spaced apart from each other and a nipping state nipping the medium 99 in between. The liquid discharge apparatus 11 is provided with an operation lever (not illustrated) that can be operated by the user to enable the driving roller 25 and the driven roller 26 to be switched between the spaced apart state and the nip state.

As illustrated in FIG. 1, the discharge unit 28 is disposed at a position facing the support portion 22. This allows the discharge unit 28 to discharge a liquid onto a portion of the medium 99 supported by the support portion 22. The liquid discharge apparatus 11 includes a gap adjustment mechanism 29 configured to adjust the gap between the discharge unit 28 and the support portion 22. The gap adjustment mechanism 29 moves the carriage 27 along the Z axis to adjust the gap between the discharge unit 28 and the support portion 22. This gap adjustment allows, regardless of the thickness of the medium 99, the gap between the discharge unit 28 and the medium 99 to be adjusted to a value suitable for printing.

As illustrated in FIG. 1, a suction mechanism 30 configured to suction the medium 99 to the support portion 22 with negative pressure is provided vertically below the support portion 22. The suction mechanism 30 is configured to apply negative pressure through a suction port 35 (see FIG. 2) that opens at a support surface 22A, which is a surface of the support portion 22 for supporting the medium 99, to suction the medium 99 to the support surface 22A.

Further, as illustrated in FIG. 1, the upstream support portion 21, the support portion 22, and the downstream support portion 23 include heaters 31, 32, and 33, respectively. Specifically, the preheater 31 configured to heat the upstream support portion 21 is provided on the back surface of the upstream support portion 21, the platen heater 32 configured to heat the support portion 22 is provided on the back surface of the support portion 22, and the afterheater 33 configured to heat the downstream support portion 23 is provided on the back surface of the downstream support portion 23. The preheater 31 is configured to preheat a portion of the medium 99 before performing printing with the heat from the upstream support portion 21 that is heated. The platen heater 32 is configured to heat a portion of the discharged region to which a liquid is discharged through nozzles 28A of the discharge unit 28 in the medium 99 with the heat from the support portion 22 that is heated. The afterheater 33 is configured to heat the portion, to which printing has been performed, of the medium 99 with the heat from the downstream support portion 23 that is heated. Note that each of the heaters 31 to 33 is composed of, for example, a planar heater.

For example, the temperature of the preheater 31 and the platen heater 32 is set to approximately 40° C., and the temperature of the afterheater 33 is set to approximately 50° C. that is higher than the temperature of the preheater 31 and the platen heater 32. The preheater 31 is configured to gradually increase the temperature of the medium 99 from the ordinary temperature toward the heating temperature of the platen heater 32 via the upstream support portion 21. The platen heater 32 is configured to heat the medium 99 via the support portion 22 to promptly dry the ink that landed on the medium 99. The afterheater 33 is configured to heat the medium 99 to a temperature that is higher than the heating temperature of the platen heater 32 via the downstream support portion 23, and to cause the liquid that landed on the medium 99 to be completely dried and fixed to the medium 99 before the medium 99 is wound to the reel mechanism 18.

As illustrated in FIG. 1, the liquid discharge apparatus 11 includes the drying device 40 as one example of the heating unit configured to heat the medium 99 to which the liquid is discharged from the discharge unit 28. The drying device 40 is located downstream of the position to which a liquid is discharged from the discharge unit 28 in the transport path. Accordingly, the drying device 40 heats and dries the medium 99 to which the liquid adheres.

The drying device 40 includes a heater tube 41 that configures one example of the heating unit. The heater tube 41 is located facing the downstream support portion 23. The heater tube 41 is configured to heat the printing surface of the medium 99 being supported and transported by the downstream support portion 23. The heater tube 41 is controlled to a predetermined heat-set temperature. In this case, as the heat-set temperature becomes higher, the output from the heater tube 41 becomes greater.

The drying device 40 includes a case 42 that accommodates the heater tube 41 and a circulation unit 43 configured to circulate gas inside the case 42. The case 42 opens at the side facing the downstream support portion 23. The circulation unit 43 includes a circulation path 44 through which gas flows, and an air blowing fan 45 located in the midstream of the circulation path 44. The circulation path 44 is a flow path coupling an intake port 46 that takes in gas and an air blowing port 47 that blows out gas. The circulation path 44 extends along a path surrounding the heater tube 41. The intake port 46 is located facing the downstream portion of the downstream support portion 23. The air blowing port 47 is located facing the upstream portion of the downstream support portion 23. The circulation unit 43 generates a first airflow AF1 by circulating the gas heated by the heater tube 41 at the paths inside the case 42 and along the upper surface of the downstream support portion 23. Specifically, a part of the gas heated near the surface of the medium 99 by the heater tube 41 is taken in through the intake port 46, and the intake gas is heated with the heat from the heater tube 41 in the course of passing through the circulation path 44. The heated gas is blown through the air blowing port 47 to the surface of the medium 99 again by the air blowing fan 45 to thus facilitate drying of the medium 99. The drying device 40 includes a reflection plate 48 that reflects the heat from the heater tube 41 toward the downstream support portion 23. The reflection plate 48 efficiently transmits heat from the heater tube 41 to the medium 99.

As illustrated in FIG. 1, the liquid discharge apparatus 11 includes a cutter device 50 configured to cut the medium 99 at a position downstream of the drying device 40 in the transport direction. In the liquid discharge apparatus 11, a selection can be made between a winding scheme in which the medium 99 after performing printing is wound as the roll body 102, and a cutting scheme in which the medium 99 after performing printing without being wound is cut to a predetermined size with the cutter device 50. The cutter device 50 includes, for example, a movable blade and a fixed blade, where the movable blade is moved along the X axis to cut the medium 99 to the predetermined size.

As illustrated in FIG. 1, a fan 51 configured to suction outside air into the housing 12 is provided in the housing 12. The fan 51 takes in the air filtered through a filter 52 through an intake port 12C provided on the housing 12 into the housing 12. A second airflow AF2 taken into the housing 12 passes through the periphery of the movement region of the discharge unit 28, and is mainly exhausted through an exhaust port 12B to the outside the housing 12. The interior of the housing 12 is ventilated with a clean air to remove foreign substances suspended in the air inside the housing 12.

The liquid discharge apparatus 11 also includes a humidity detection unit 53 configured to detect a humidity. In this example, the humidity detection unit 53 is provided inside the housing 12. The humidity detection unit 53 detects the humidity of the air taken in from the exterior of the housing 12 at a position downstream of the fan 51 in the air intake direction of the fan 51 inside the housing 12. This detection humidity corresponds to the humidity at the exterior of the housing 12, that is, a detection value of the humidity at the periphery of the liquid discharge apparatus 11.

The humidity detection unit 53 of this example includes a temperature/humidity sensor configured to detect a temperature in addition to a humidity. The temperature/humidity sensor detects the humidity and temperature of the outside air near the intake port of the outside air into the housing 12. The humidity detection unit 53 is located at the upper portion relative to the lower portion at which the discharge unit 28 is located inside the housing 12. Here, the lower portion inside the housing 12 tends to be relatively highly humid due to the influence of moisture vapor evaporated from the liquid adhering to the medium 99 immediately after performing printing is performed and the like. Further, at the lower portion inside the housing 12, the temperature of the outside air cannot be accurately detected due to the influence of the heat from the heating source such as the platen heater 32. Accordingly, the temperature/humidity sensor configuring the humidity detection unit 53 detects a humidity and temperature at the upper position inside the housing 12 that is not susceptible to this kind of moisture vapor and heating source. Note that the humidity detection unit 53 may be attached to the outer side face of the housing 12.

As illustrated in FIG. 1, a humidifier 54 may be provided, inside the housing 12, as one example of a humidifying unit configured to humidify the interior of the housing 12. The humidifier 54 is driven by a control unit 70 when the humidity detected by the humidity detection unit 53 is not within a suitable humidity range. That is, when the humidity of the air at the exterior of the housing 12 (hereinafter, also referred to as "outside air") detected by the humidity detection unit 53 is less than a lower limit value A, the control unit 70 drives the humidifier 54 under certain conditions to increase the humidity at the periphery of the medium transport path inside the housing 12. This is because, when the humidity of the outside air is low, foreign substances such as dust and fluff are easily suspended in the air, to thus increase the content percentage of the foreign substances in the air taken into the housing 12. Accordingly, increasing the humidity inside the housing 12 causes the foreign substances suspended in the air to be precipitated, to thus suppress the occurrence of nozzle clogging due to the foreign substances. Note that a second humidity detection unit configured to detect the humidity in a humidified region in which the humidifier 54 performs humidification may be provided inside the housing 12, and the control unit 70 may drive and control the humidifier 54 based on the detection humidity of the second humidity detection unit, to thus adjust the humidity at the periphery of the discharge unit 28 to the target humidity. Further, the user may operate an operation panel 72 to select whether the humidifier 54 is driven.

The humidifier 54 includes a water reservoir section that retains water, and a humidification drive unit that converts the water in the water reservoir section into mist or moisture vapor. The humidification drive unit may be any type of a vapor type, an evaporated type, an ultrasonic type, an electrolysis type for performing humidification accompanying electrolysis of water using a solid polymeric electrolyte, or the like.

Further, as illustrated in FIG. 1, the liquid discharge apparatus 11 is installed with a dust catcher 55 as necessary on a feeding port 12A through which the medium 99 is fed into the housing 12. The dust catcher 55 is disposed upstream of the discharge unit 28 in the transport direction Y1, and comes in contact with a printed surface 99A at a portion before the liquid is discharged from the discharge unit 28. The dust catcher 55 comes in contact with the printed surface 99A in a state of substantially closing the feeding port 12A. The dust catcher 55 removes foreign substances such as dust and fluff adhering to the printed surface 99A, and suppresses the air in which the foreign substances are suspended from flowing into the housing 12 through the feeding port 12A. The dust catcher 55 is attached to a predetermined position near the feeding port 12A of the housing 12 with a magnet or screw. The dust catcher 55 of this example is configured to control a pressing force for pressing against the printed surface 99A.

Further, a display unit 60 is provided on the outer face of the housing 12. The display unit 60 displays various messages and the like for the user, in addition to various menu screens, input screens for printing condition information, and the like. The liquid discharge apparatus 11 includes the control unit 70 inside the housing 12. The control unit 70 controls the transport unit 14, the feeding unit 15, the winding unit 17, the discharge unit 28, the carriage 27, the drying device 40, the display unit 60, and the like.

The liquid discharge apparatus 11 is used with selecting one of the winding scheme illustrated in FIG. 1, in which the medium 99 dried after performing printing is wound, or a non-winding scheme in which the medium 99 dried after performing printing is not wound. In the non-winding scheme, the medium 99 after performing printing is cut to a predetermined size with the cutter device 50 or is ejected in an elongated form without being cut.

Figure 2:
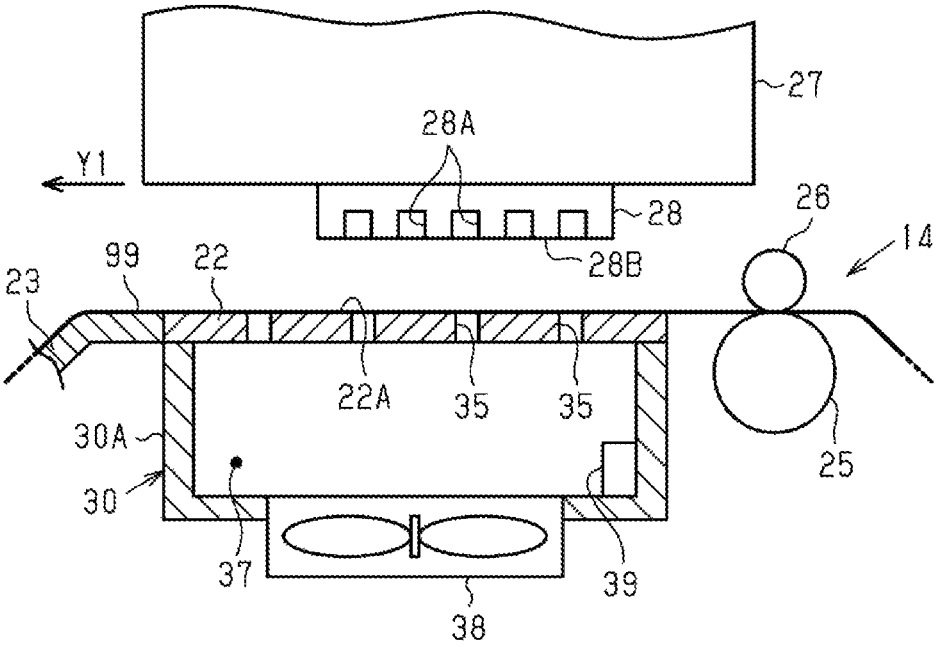
FIG. 2 is a side cross-sectional view schematically illustrating a suction mechanism.

Next, a detailed configuration of the suction mechanism 30 will be described with reference to FIG. 2. As illustrated in FIG. 2, the support portion 22 includes the suction port 35 that opens at the support surface 22A for supporting the medium 99. The liquid discharge apparatus 11 includes the suction mechanism 30 configured to generate negative pressure for causing a suction force to be exerted through the suction port 35 to suction the medium 99. To the lower portion of the support portion 22, a negative pressure chamber forming member 30A is assembled. Further, a negative pressure chamber 37 is formed surrounded by the support portion 22 and the negative pressure chamber forming member 30A. The suction port 35 communicates with the negative pressure chamber 37 through the support portion 22. A plurality of suction holes 35 that communicate with the negative pressure chamber 37 open at the support surface 22A. The suction mechanism 30 includes an exhaust fan 38 configured to exhaust the air inside the negative pressure chamber 37 to the outside. When the exhaust fan 38 is driven, the air inside the negative pressure chamber 37 is exhausted to the outside, and the pressure inside the negative pressure chamber 37 becomes negative. Thus, a portion of the medium 99, which is supported by the support portion 22, is suctioned to the support surface 22A by the negative pressure applied through the plurality of suction ports 35 that open at the support surface 22A. In this regard, the suction mechanism 30 configures one example of a force applying unit configured to apply a force in a direction approaching the support portion 22 to a portion of the medium 99, which is supported by the support portion 22.

In the liquid discharge apparatus 11, when there is a possibility that wrinkles 99S and floating occur in the medium 99 at the time when the discharge unit 28 discharges a liquid to print an image on the medium 99, the exhaust fan 38 is driven to cause the medium 99 to be suctioned to the support surface 22A. Further, a pressure sensor 39 configured to detect a pressure is provided inside the negative pressure chamber 37. The control unit 70, based on the detection pressure detected by the pressure sensor 39, controls the suction mechanism 30 such that the pressure inside the negative pressure chamber 37 reaches a predetermined set negative pressure value. In the first embodiment, a negative pressure is applied through the suction port 35 when the medium 99 is transported as well, and a suction force that suctions the medium 99 to the support surface 22A is exerted on the medium 99 being transported. The suction force that causes the medium 99 to be suctioned to the support surface 22A increases the transport load of the medium 99, and also causes the wrinkles 99S to occur due to the transport load. Accordingly, the control unit 70 drives the suction mechanism 30 in order to suppress the occurrence of the wrinkles 99S under the humidity environment in which the occurrence of the wrinkles 99S or the like possibly occur in the medium 99, however, otherwise, the control unit 70 performs printing in a state of stopping the suction mechanism 30. Note that the control unit 70 may perform control that does not cause negative pressure to be applied through the suction port 35 while the medium 99 is transported.

Figure 3:
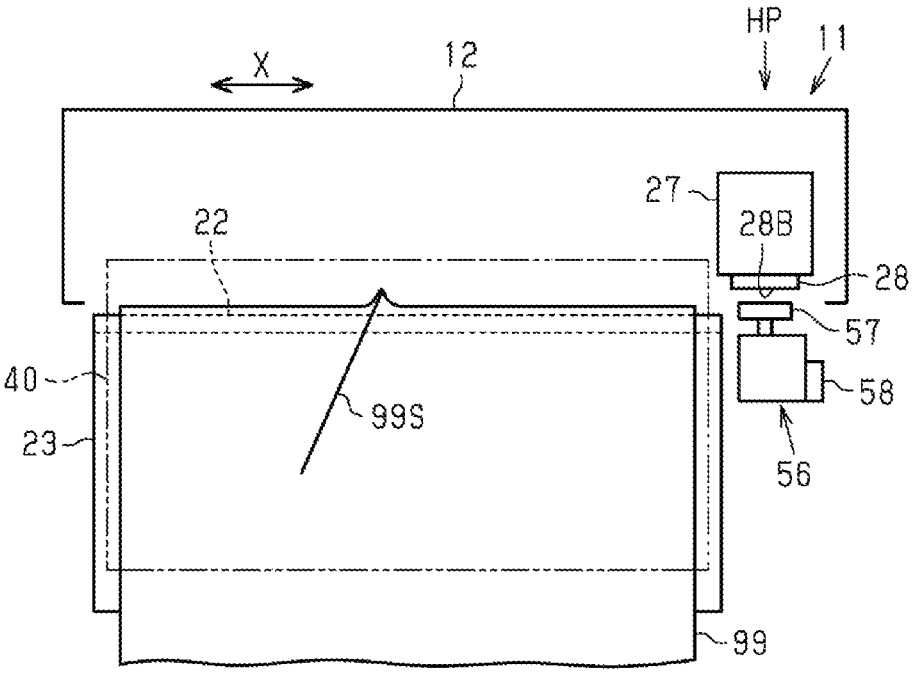
FIG. 3 is a front view schematically illustrating a liquid discharge apparatus.

As illustrated in FIG. 3, the carriage 27 reciprocatively moves along the X axis inside the housing 12. One end position of the movement range of the carriage 27 is a home position HP at which the carriage 27 stands by when printing is not performed by the discharge unit 28. A maintenance device 56 is disposed at the position facing the discharge unit 28 when the carriage 27 is at the home position HP. The maintenance device 56 performs cleaning of the nozzles 28A periodically as a discharge maintenance operation of the discharge unit 28 before or after performing printing based on a print job. The maintenance device 56 includes a cap 57, and a suction pump 58 configured to suction the air inside the cap 57. The cap 57 is provided movable along the Z axis, and can be separated from and in contact with a nozzle opening surface 28B at which the nozzles 28A open, of the discharge unit 28. When the cap 57 is in a capping state where the cap 57 is in contact with the nozzle opening surface 28B of the discharge unit 28, the suction pump 58 is driven to suction the air within the closed space surrounded by the nozzle opening surface 28B and the cap 57, to thus cause the interior of the cap 57 to be at a negative pressure. This allows the liquid to be forcibly suctioned and discharged through the nozzles 28A. This makes it possible to remove a defective liquid such as a thickening ink or the like inside the nozzles 28A and the air bubbles contained in the liquid. Note that the maintenance device 56, in addition to a suction scheme, may also be a pressure scheme in which a liquid is forcibly discharged through the nozzles 28A by pressurizing a liquid supply source (for example, an ink pack) that supplies the liquid to the discharge unit 28.

In this example, the liquid discharge apparatus 11 produces a printed material that printing is performed on the medium 99. The liquid discharge apparatus 11 may be configured as a textile printing machine of a sublimation-transfer type that the discharge unit 28 discharges a liquid to perform printing on a transfer paper being one example of the medium 99, and transfers the printed image from the transfer paper to a cloth. The liquid discharge apparatus 11, when being a textile printing machine, includes a pasting roller, in place of the tension bar 20 and the suction mechanism 30, as the function of pressing the medium 99 against the support surface 22A of the support portion 22. Driving the pasting roller to press the medium 99 against the support surface 22A has an effect of suppressing the occurrence of the wrinkles 99S in the medium 99, as in the suction mechanism 30. In this regard, the pasting roller configures one example of a force applying unit configured to apply a force in the direction approaching the support portion 22 to a portion of the medium 99, which is supported by the support portion 22.

Figure 4:
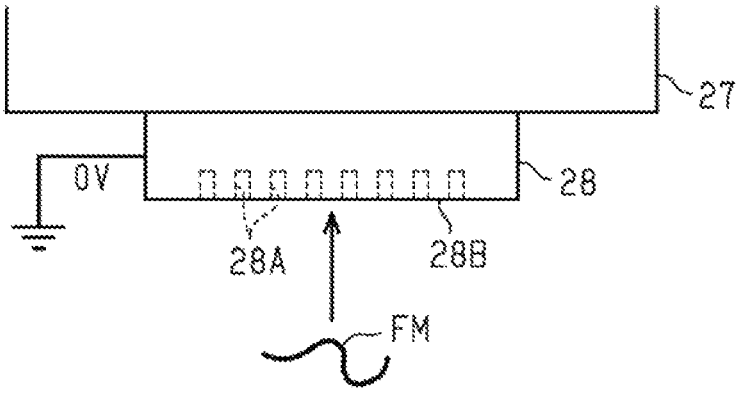
FIG. 4 is a view schematically illustrating how foreign substances adhere to a discharge unit.

Further, as illustrated in FIG. 4, the discharge unit 28 disposed inside the housing 12 is grounded via a metal frame or the like. Accordingly, the electrical potential of the nozzle opening surface 28B at which the nozzles 28A open in the discharge unit 28 is 0 V. Foreign substances FM suspended in the air such as dust and fibers are charged. Accordingly, the foreign substances FM suspended in the air inside the housing 12 adhere to the nozzle opening surface 28B of the discharge unit 28 by Coulomb's force. The foreign substances FM adhering to the nozzle opening surface 28B causes a nozzle clogging. The nozzle clogging leads to a discharge failure that the discharge amount of the liquid is less than the expected amount or the liquid is failed to be discharged. The discharge failure will cause a printing failure.

When the humidity is at a first humidity, the foreign substances FM, such as dust and fibers, are easily suspended in the air compared to when the humidity is at the second humidity exceeding the first humidity. In the first embodiment, when the humidity detection unit 53 detects a humidity less than the lower limit value A of a humidity range suitable for printing, there is a concern in that nozzle clogging and the like occur due to the foreign substances FM. Then, the control unit 70, when the humidity detection unit 53 detects a humidity less than the lower limit value A of the humidity range suitable for printing, performs control of humidifying the interior of the housing 12. Further, the control unit 70, when the humidity detection unit 53 detects a humidity less than the lower limit value A of the humidity range suitable for printing, performs control to suppress the occurrence of nozzle clogging due to the foreign substances FM. Note that the details of the control performed by the control unit 70 will be described later.

As illustrated in FIG. 3, when the humidity outside the housing 12 is high, the occurrence of the wrinkles 99S in the medium 99 to which the discharged liquid adheres is facilitated. This is because of the following reasons. When the humidity outside the housing 12 is high, the moisture contained in the medium 99 increases. That is, when the humidity is high, the moisture content of the medium 99 before performing printing is high. When the moisture content of the medium 99 is high, the total moisture content of the medium 99 immediately after performing printing and to which the liquid is discharged from the discharge unit 28 adheres is high. That is, the total moisture content of the medium 99 immediately after performing printing is higher when the humidity is at the second humidity exceeding the first humidity than when the humidity is at the first humidity even when the liquid amount that is discharged is the same.

When the total moisture content of the medium 99 immediately after performing printing is high, the medium 99 to which the liquid adheres is hardly dried, and moreover, the amount of expansion of the medium 99 when the fibers of the medium 99 absorb the liquid to swell increases, and the occurrence of the wrinkles 99S is facilitated due to the increase in the amount of contraction when the medium 99, which has greatly swollen and expanded, contracts during the drying process.

As illustrated in FIG. 3, the wrinkles 99S occurred at the portion, to which printing has been performed, of the medium 99 may propagate upstream in the transport direction Y1 to the portion facing the discharge unit 28. In this case, when the wrinkles 99S are rubbed against the nozzle opening surface 28B of the discharge unit 28, the medium 99 is stained with an ink to cause a printing failure. Then, the control unit 70, when the humidity detection unit 53 detects a humidity exceeding the upper limit value B of the humidity range suitable for printing, performs control to suppress the occurrence of the wrinkles 99S. Note that the details of the control performed by the control unit 70 will be described later.

Figure 5:
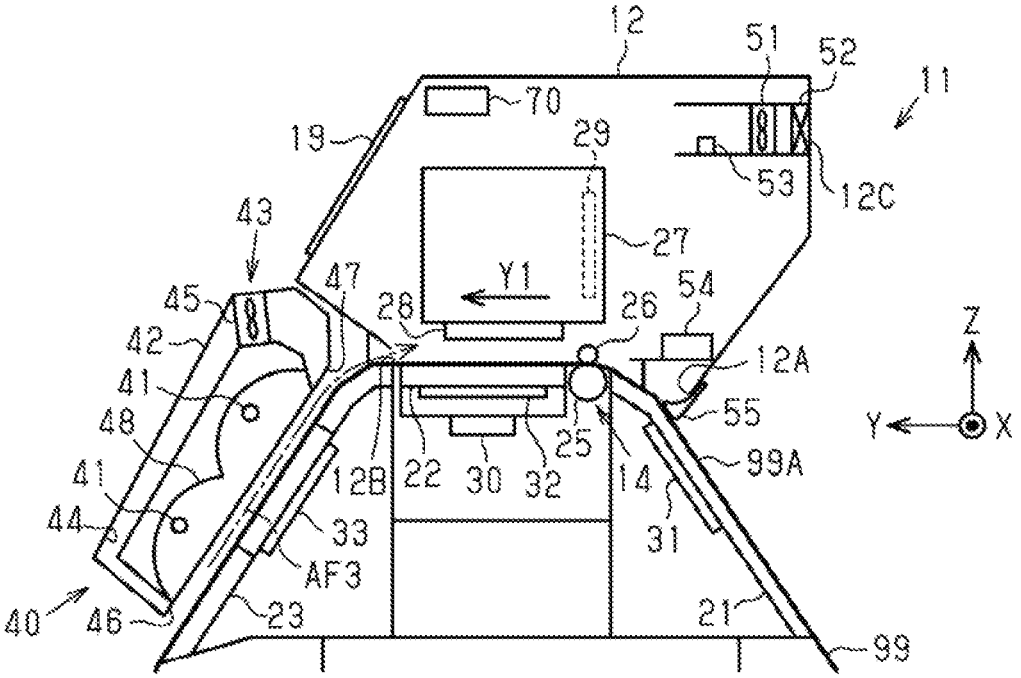
FIG. 5 is a partial side cross-sectional view schematically illustrating a liquid discharge apparatus.

Next, with reference to FIG. 5, a humidification mode for humidifying the interior of the housing 12 using the drying device 40 will be described below. As illustrated in FIG. 5, when the heater tube 41 performs heating in a state where the control unit 70 stops the air blowing fan 45 in the drying device 40, a third airflow AF3 that the heated air between the case 42 and the downstream support portion 23 flows upward by a chimney effect toward the housing 12, is generated. The third airflow AF3 is a highly humid airflow including moisture vapor evaporated from the liquid adhering to the medium 99. The third airflow AF3 flown upward flows into the housing 12 through the exhaust port 12B. The liquid discharge apparatus 11 of the first embodiment includes the fan 51 that causes the second airflow AF2 to be exhausted through the exhaust port 12B for the purpose of ventilating the interior of the housing 12 with a clean air. Accordingly, in order not to prevent the third airflow AF3 flown upward from flowing into the housing 12 through the exhaust port 12B, the control unit 70 stops driving the fan 51 inside the housing 12 or drives the fan 51 with less blowing power. This allows the humidity inside the housing 12 to rise. The control unit 70, by driving and controlling the drying device 40 in this way, allows the liquid discharge apparatus 11 to be operated in the humidification mode. In this example, the drying device 40 in the humidification mode configures one example of the humidifying unit. The user can operate the operation panel 72 to instruct the liquid discharge apparatus 11 to perform automatic operation in the humidification mode. The control unit 70, when the humidity detection unit 53 detects a humidity less than the lower limit value of the humidity range suitable for printing, drives the drying device 40 as a humidifying unit in the humidification mode.

Next, with reference to FIG. 6, an electrical configuration of the liquid discharge apparatus 11 will be described below. The liquid discharge apparatus 11 includes the control unit 70. The control unit 70 is electrically coupled with a communication unit 71, the operation panel 72, the humidity detection unit 53 configured to detect the humidity at the exterior of the housing 12, a temperature detector 73 configured to detect the temperature of the heating region heated by the drying device 40, and the pressure sensor 39 configured to detect the pressure of the negative pressure chamber 37 of the suction mechanism 30. The operation panel 72 includes the display unit 60 and an operation unit 74. When the display unit 60 is a touch panel, the operation unit 74 may be configured by an operation functional unit of a touch panel.

The control unit 70 is communicably coupled with a host apparatus 150 via the communication unit 71. The host apparatus 150 includes a display unit 160 and an operation unit 170 operated by the user. The host apparatus 150 includes a print driver (not illustrated) configured to generate data of a print job PJ when the user operates the operation unit 170 to provide a command for printing. The control unit 70 receives the data of the print job PJ from the host apparatus 150 via the communication unit 71. Note that the host apparatus 150 is configured by one of a personal computer, a Personal Digital Assistant (PDA), a tablet PC, a smart phone, a mobile phone, or the like, for example.

The humidity detection unit 53 includes a humidity sensor 75 configured to detect the relative humidity outside the housing 12, and a temperature sensor 76 configured to detect the temperature outside the housing 12. The humidity detection unit 53 of this example is composed of a temperature/humidity sensor that the humidity sensor 75 and the temperature sensor 76 are built into a single sensor unit. The humidity detection unit 53 calculates an absolute humidity AH in accordance with a predetermined calculation equation using information about a relative humidity RH (%) detected by the humidity sensor 75 and a temperature T (° C.) detected by the temperature sensor 76. The absolute humidity AH is calculated with $AH=217\times e(T)/(T+273.15)\times RH/100$, where e(T) is saturation vapor pressure and is calculated using Tetens equation given as $e=6.11\times 10\hat{}(7.5T/(T+237.3))$. Note that the humidity detection unit 53 may be configured to include a part (humidity calculation unit) of the control unit 70 configured to calculate the absolute humidity AH from each of the values of the humidity and temperature detected by the humidity sensor 75 and the temperature sensor 76, respectively. In addition, the humidity detection unit 53 may be configured to include the humidity sensor 75 and the temperature sensor 76 separately in place of the temperature/humidity sensor. Alternatively, one or both of the humidity sensor 75 and the temperature sensor 76 may be provided at the external of the housing 12.

The control unit 70 is input with, via a non-illustrated input interface, an operation signal generated when the operation unit 74 is operated, a humidity detection value detected by the humidity sensor 75, a temperature detection value detected by the temperature sensor 76, an absolute humidity detection value detected by the humidity detection unit 53 based on information about humidity and temperature, a pressure detection signal from the pressure sensor 39, and a temperature detection signal from the temperature detector 73.

The control unit 70 is also electrically coupled with the feeding motor 16, the transport motor 77, the winding motor 19, the discharge unit 28, a carriage motor 78, the suction mechanism 30, the preheater 31, the platen heater 32, the afterheater 33, the gap adjustment mechanism 29, the humidifier 54, and the maintenance device 56. The control unit 70 is also electrically coupled with the heater tube 41 and the air blowing fan 45 configuring the drying device 40. The transport motor 77 is the drive source for the driving roller 25 configuring the transport unit 14. The carriage motor 78 is the drive source for the carriage 27. Note that the liquid discharge apparatus 11, when being a line printer, is electrically configured such that the carriage motor 78 is removed from the configuration in FIG. 6.

The print job PJ received by the control unit 70 from the host apparatus 150 contains various commands necessary for the print control, the printing condition information designated by the user, and the print image data. The control unit 70 controls various motors 16, 19, and 77 and the like based on the printing condition information contained in the print job PJ, and controls the discharge unit 28 based on the print image data to discharge a liquid through the nozzles 28A, to thus draw an image with dots formed by droplets that land on the medium 99. Note that hereinafter, the term "print job PL" is also referred to as "job PJ" in a simple manner.

The control unit 70 drives the gap adjustment mechanism 29 in accordance with a medium type acquired from the printing condition information to displace the carriage 27 along the Z axis, to thus adjust the gap between the discharge unit 28 and the medium 99 to a value corresponding to the medium type. The control unit 70, when the "high definition printing" of high print resolution is required in the job PJ, performs adjustment of the gap between the discharge unit 28 and the medium 99 to a first gap in order to enhance the dot position accuracy of the discharge unit 28. On the other hand, the control unit 70, when the "regular printing" of low print resolution is required in the job PJ, printing speed is prioritized over the dot position accuracy of the discharge unit 28, and thus the gap is adjusted to a second gap greater than the first gap. In this way, even with the same medium type, the gap is adjusted in accordance with the print resolution that is required. Note that the gap adjustment mechanism 29 employs a mechanically driven scheme in which the control unit 70 causes the carriage 27 to reciprocatively move in a predetermined interval within the movement region, and causes the carriage 27 to operate a drive lever (not illustrated) to mechanically drive the gap adjustment mechanism 29, or an electrical operation scheme in which a dedicated motor is driven to adjust the gap.

The control unit 70 measures the elapsed time since the previous cleaning time with a non-illustrated timer, and provides, when the elapsed time has elapsed for a predetermined period of time and reaches the edge period of the job PJ, that is, the cleaning time set before or after the job, a command for performing a discharge maintenance operation to the maintenance device 56 in a state where the carriage 27 is disposed at the home position HP. The maintenance device 56 causes, based on the command from the control unit 70, the cap 57 to be in a capping state where the cap 57 is brought into contact with the nozzle opening surface 28B of the discharge unit 28, and causes a liquid to be forcibly discharged through the nozzles 28A, to thus perform cleaning of the nozzles 28A.

Figure 6:
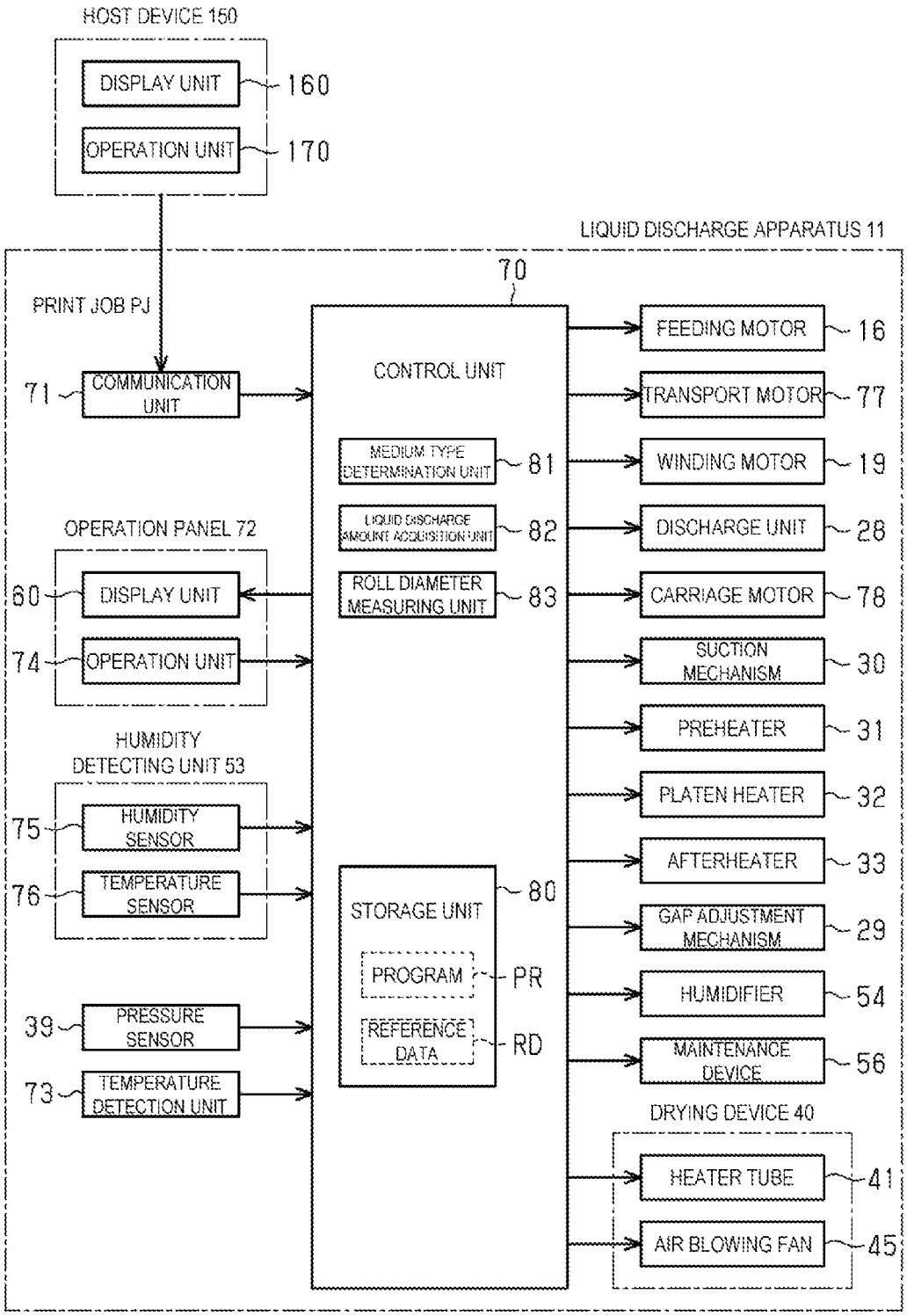
FIG. 6 is a block diagram illustrating an electrical configuration of a liquid discharge apparatus.
Figure 9:
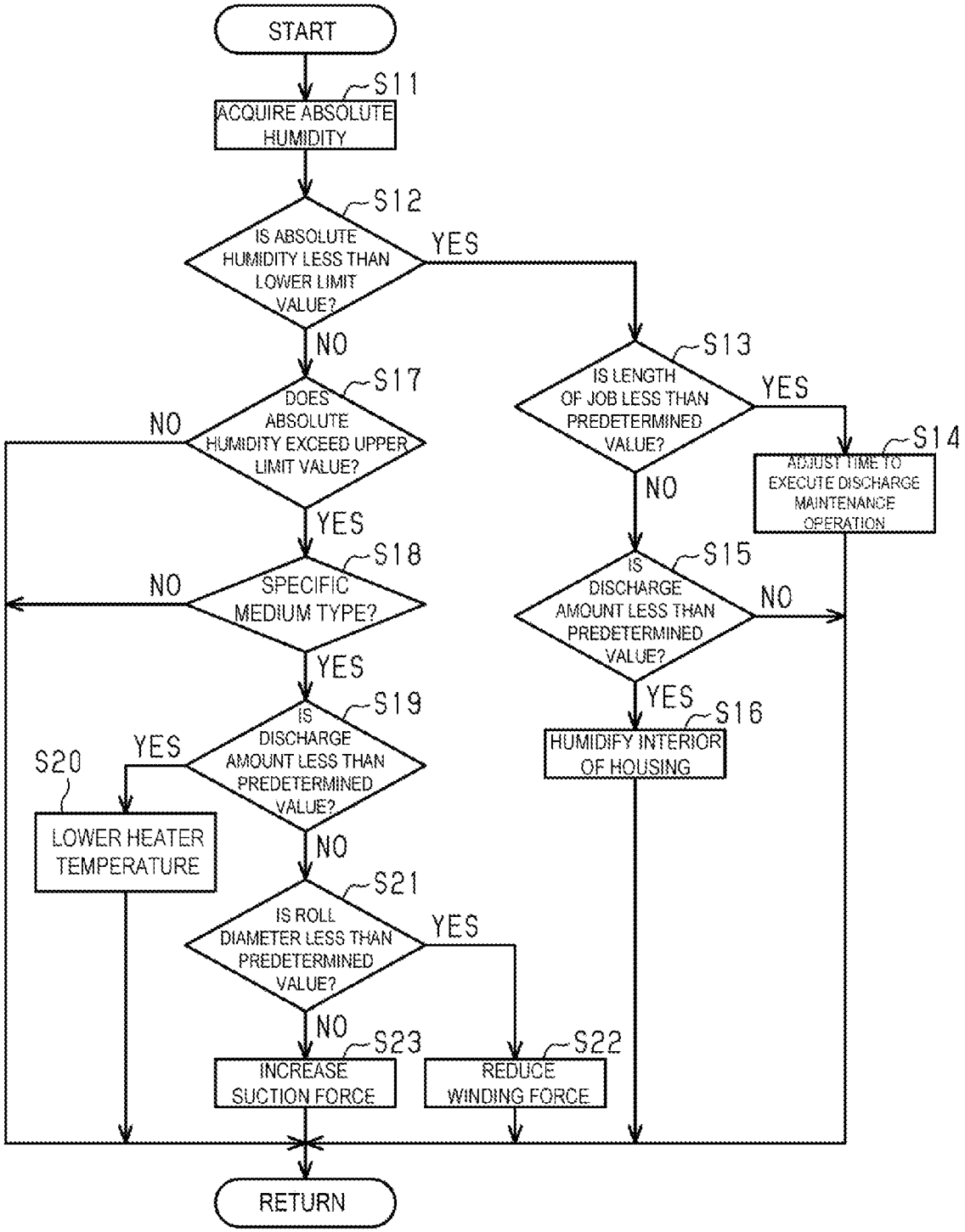
FIG. 9 is a flowchart illustrating a control sequence of performing control based on environmental information during printing.

The control unit 70 illustrated in FIG. 6 includes a CPU, an Application Specific Integrated Circuit (ASIC), and a storage unit 80 (memory) composed of a RAM, a nonvolatile memory, and the like. The CPU executes a control program stored in the storage unit 80 to administrate various types of control including print control. The storage unit 80 stores a program PR of the control sequence illustrated in the flowchart in FIG. 9 included in the control program, and reference data RD referred to when performing the determination process for determining whether the humidity detection unit 53 detects a humidity within the humidity range suitable for printing in the control sequence. The CPU of the control unit 70 executes the program PR after the liquid discharge apparatus 11 is powered on. The control unit 70 also refers to the reference data RD based on the absolute humidity AH detected by the humidity detection unit 53 to determine whether the absolute humidity AH thus detected is in a printing environment appropriate region HA suitable for printing. The printing environment inappropriate region HA, which is a range of the absolute humidity suitable for printing, is defined by the lower limit value A and the upper limit value B in the range. The control unit 70 also includes a medium type determination unit 81, a liquid discharge amount acquisition unit 82, and a roll diameter measuring unit 83 as function units that function by executing the program PR.

The medium type determination unit 81 determines a medium type being a type of the medium. The medium type determination unit 81 determines the medium type based on medium type information in the printing condition information contained in the job PJ. Examples of the medium type include plain paper, glossy paper, matte paper, and the like. In addition, the information about the medium type contains information about basis weight regarding the medium thickness. Accordingly, the medium type determination unit 81 distinguishes thin paper, cardboard, or the like that are classified by the medium thickness using the information about the basis weight, without the medium type being limited to plain paper, glossy paper, and the like, to determine the medium type. The medium type determination unit 81 determines whether the medium 99 is of a specific medium type.

The liquid discharge amount acquisition unit 82 acquires an average discharge amount, which is the discharge amount per medium area of the liquid discharged from the discharge unit 28. The liquid discharge amount acquisition unit 82 calculates the total amount (g) of the liquid discharged for one image based on the image data contained in the job PJ, and divides the total liquid amount by the medium area (mm^2) on which the image is to be printed, to thus acquire the average discharge amount (g/mm^2). The value of the average discharge amount is multiplied with "100" to obtain the average discharge amount (%). For example, a solid printing, which ink adheres to the entire image region and with no white space, has the average discharge amount of 100%. Note that the symbol "^" indicates power. The "m^2" indicates square meters. In addition, the "m^3" that will be described later indicates cubic meters.

The roll diameter measuring unit 83 measures the roll diameter of the roll body 102 loaded on the winding unit 17. The roll diameter measuring unit 83 acquires the medium type and the basis weight from the printing condition information of the medium 99. The user also operates the operation panel 72 or the operation unit 170 of the host apparatus 150 to input the initial roll size when the roll body 102 is loaded on the winding unit 17. The roll diameter measuring unit 83 counts the number of pulse edges of the detection pulse input from the rotary encoder configured to detect the rotation of the winding motor to acquire the winding rotation amount of the roll body 102. The roll diameter measuring unit 83 measures the current roll diameter using the initial roll diameter, the winding rotation amount, and the medium thickness. Here, even if the winding force of the winding unit 17 is constant, when the roll diameter of the roll body 102 becomes greater, the front tension exerted on the medium 99 become relatively greater. Note that the roll diameter measuring unit 83 may be configured to include a sensor configured to measure the roll diameter of the roll body 102 loaded on the winding unit 17, to measure the roll diameter based on the detection value of the sensor.

Note that the control unit 70, upon receiving a command for initiating reel measurement in a state where the medium 99 is set to the transport unit 14 after powered on, executes the reel measurement. In the reel measurement, the winding load is measured when the winding unit 17 is caused to wind the medium 99 under a state where no tension is being exerted on the medium 99. The control unit 70 then adds the torque corresponding value of the target tension to be exerted on the medium 99 corresponding to the medium type and the medium width to the torque corresponding value of the winding load obtained from the measurement result of the reel measurement, to obtain a target rotational torque over the control of the winding motor 19. The control unit 70 controls the winding motor 19 with the obtained target rotational torque to thus apply a front tension, which is a tension exerted on the region between the transport unit 14 and the roll body 102 in the medium 99 being wound.

The control unit 70 also controls the transport amount of which the transport unit 14 transports the medium 99 and the feed amount by which the feeding unit 15 feeds out the medium 99 from the roll body 101, to apply a back tension, which is a tension exerted on the region between the roll body 101 and the transport unit 14 in the medium 99. Specifically, the control unit 70 transports the medium 99 while controlling the feed amount to be slightly less than the transport amount to cause a slight slippage between the rollers, to thus apply a back tension to the medium 99.

In the liquid discharge apparatus 11 of this example, the liquid discharged from the discharge unit 28 is a water-based ink, for example. Accordingly, in the heating and drying process in which the medium 99 to which the discharged liquid adheres is heated for drying, a moisture vapor evaporated from water in the liquid is generated. In addition, the medium 99 is, for example, a paper, and the medium 99 to which the discharged liquid adheres expands when the paper fibers absorb the liquid and swell, and then constricts when the moisture is evaporated and dried in the heating and drying process. The amount of expansion and constriction of the medium 99 at this time varies depending on the medium type and the average discharge amount (%). Note that the solvent or dispersion medium contained in the liquid may be a water-soluble organic solvent. The solvent or dispersion medium may further be a water-insoluble organic solvent.

Figure 7:
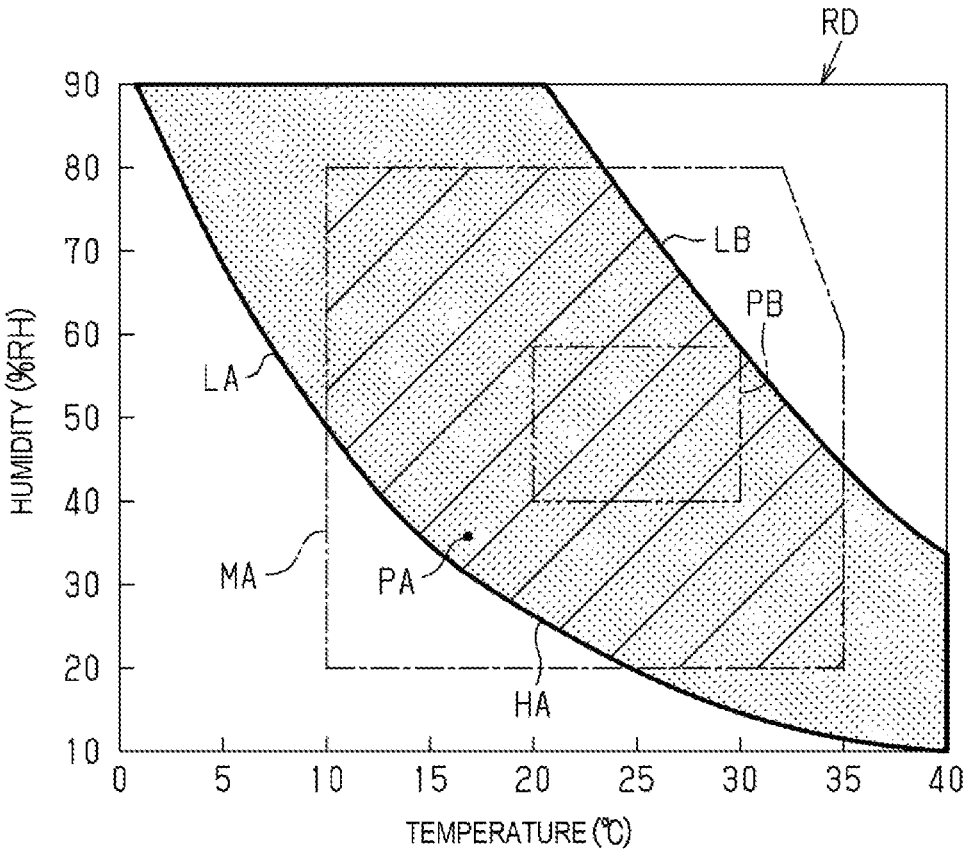
FIG. 7 is a graph illustrating a content of reference data and illustrating a printing environment appropriate region related to absolute humidity.

FIG. 7 is an explanatory graph for the reference data RD referred to when the control unit 70 determines whether the absolute humidity falls within the printing environment appropriate region HA that is suitable for printing. The reference data RD is set based on the result of the experimental data indicated in this graph.

In the graph illustrated in FIG. 7, the horizontal axis is temperature (° C.), and the vertical axis is relative humidity (% RH). A line LA in the graph is the lower limit line indicating the lower limit value A (g/cm^3) of the printing environment appropriate region HA, and A line LB is the upper limit line indicating the upper limit value B (g/cm^3) of the printing environment appropriate region HA, where the absolute humidity represents the density of moisture vapor contained in the atmosphere. In contrast, the amount of moisture (saturated moisture vapor content) that an air can contain in the form of moisture vapor is determined to a constant value by temperature under atmospheric pressure. With this limit value being 100, a numerical value represented by some percentage % of the amount of moisture in the actual air per the maximum limit, is the relative humidity (% RH).

The region below the line LA where the absolute humidity AH is less than the lower limit value A (g/m^3) is a first inappropriate region in which the ratio of the foreign substances FM such as dust and fluff being suspended in the atmosphere is high, facilitating the occurrence of the printing failure caused by nozzle clogging due to the adhesion of the foreign substances FM to the discharge unit 28. Further, the region above the line LB where the absolute humidity AH exceeds the upper limit value B (g/m^3) of the printing environment appropriate region HA is a second inappropriate region in which the wrinkles 99S easily occur due to high humidity. In the second inappropriate region, the medium 99 absorbs the moisture in the atmosphere to increase the moisture content in the medium 99, increasing the total moisture content in the medium 99 to which the liquid has adhered. Then, the amount of expansion and contraction when the medium 99 expands and contracts during the drying process increases. This facilitates the occurrence of the wrinkles 99S. That is, the line LB is a boundary line that indicates the threshold value at which the occurrence of the wrinkles 99S in the medium 99 is facilitated when the absolute humidity exceeds the value of the line LB.

The upper limit value B is a value greater than the lower limit value A (B>A). The lower limit value A is a value within the range from 3 to 7 (g/cm^3), as one example. Further, the upper limit value B is a value within the range from 13 to 20 (g/cm^3), as one example. The lower limit value A and the upper limit value B vary depending on the models of the printer because the printing conditions and the heating/drying conditions vary for each of the models. In addition, the lower limit value A and the upper limit value B vary depending on the types of the medium 99 even with the same one model.

In the graph of FIG. 7, the range in which the absolute humidity is not less than the lower limit value A and not greater than the upper limit value B (g/m^3) is set as the printing environment appropriate region HA. Thus, as for the liquid discharge apparatus 11, the printing environment appropriate region HA, which is a range surrounded by the thick line in the graph illustrated in FIG. 7, is the recommended range regarding the humidity. Further, in the graph of FIG. 7, the region PB surrounded by the two-dot chain line is the recommended range of the comparative example. Traditionally, the user used to adjust the temperature and humidity within a room where the liquid discharge apparatus 11 is installed to fall within the recommended range of the comparative example. For example, the indoor temperature is adjusted with an air conditioner, and the indoor humidity is adjusted using a humidifier.

In addition, the liquid discharge apparatus 11 has a suitable operating environment regarding the absolute humidity. For example, in view of the operating performance of the liquid discharge apparatus 11 and the durability of the components, an operating environment appropriate region MA is set as the range of the absolute humidity suitable for the operation. In the graph illustrated in FIG. 7, the operating environment appropriate region MA is the square frame region indicated by the dot-and-dash line. Accordingly, in the liquid discharge apparatus 11, a printing appropriate region PA, which is a region where the printing environment appropriate region HA overlaps with the operating environment appropriate region MA, is actually the recommended region. Note that the operating environment appropriate region MA may be a region encompassing the printing environment appropriate region HA, or may be omitted as long as the operating performance, the durability of the components, and the like is guaranteed in the normal range of use.

The range of the absolute humidity AH defining the printing environment appropriate region HA illustrated in FIG. 7 is the reference data RD stored in the storage unit 80. The control unit 70, by referring to the reference data RD, determines whether the absolute humidity AH detected by the humidity detection unit 53 falls within the printing environment appropriate region HA illustrated in FIG. 7. That is, the control unit 70 determines whether the absolute humidity AH detected by the humidity detection unit 53 falls within the range of not less than the lower limit value A or not greater than the upper limit value B. Note that a method for determining, based on the relative humidity RH detected by the humidity sensor 75 (RH %) and the temperature T (° C.) detected by the temperature sensor 76, whether the temperature T and humidity RH at present fall within the printing environment appropriate region HA with reference to the reference data RD composed of the two-dimensional map illustrated in FIG. 7 may be employed.

Note that the control unit 70 calculates the absolute humidity AH using the relative humidity RH detected by the humidity sensor 75 and the temperature T detected by the temperature sensor 76 by the following method. In addition, the control unit 70 separately determines whether the current absolute humidity falls within the operating environment appropriate region MA. Then, the control unit 70 may humidify the interior of the housing 12 by driving the humidifier 54 or an operation under the humidification mode to cause the absolute humidity AH to fall within the printing appropriate region PA indicated by the hatching in FIG. 7.

In the liquid discharge apparatus 11, one set of the job PJ is a unit of command data that can instruct, at one time, the liquid discharge apparatus 11 to print one image or to sequentially print a plurality of images. The user can perform processing called nesting that connects a plurality of images to lengthen the one set of the job PJ, to thus eliminate a wasted white space between images. When a cleaning is performed at the middle of an image when performing printing, color unevenness occurs at the middle of the image. Accordingly, a discharge maintenance operation for cleaning the nozzles 28A before the start or after the termination of the printing operation based on the one set of the job PJ is performed. When the one set of the job PJ is lengthened, the length that can be printed without causing white spaces can be elongated, to thus enhance the productivity of the printed material. However, when the length of the job PJ is lengthened, there is a concern in that the cleaning interval is elongated to increase the occurrence frequency of clogging of the nozzles 28A.

Accordingly, the liquid discharge apparatus 11 guarantees the length of the job PJ that does not cause the printing failure caused by nozzle clogging or the like to occur without performing cleaning. The user sets the length of the job PJ within the range not greater than an upper limit L1 (m) of a guaranteed job length MLBD that is the length of the job PJ that is guaranteed. The user performs processing of connecting a plurality of images within the range not greater than the upper limit of the guaranteed job length MLBD to lengthen the one set of the job PJ to reduce the white space between jobs. In addition, the guaranteed job length MLBD is a value guaranteed when the absolute humidity AH falls within the printing environment appropriate region HA, where the absolute humidity AH is less than the lower limit value A, then the guaranteed job length MLBD is no longer guaranteed. That is, the guaranteed job length MLBD is shortened. In this case, the user processes the length of the job PJ to a value less than the upper limit of the guaranteed job length MLBD that is guaranteed under the humidity at that time after the guaranteed job length MLBD is changed. Even if the absolute humidity AH is less than the lower limit value A, the length of the job PJ is set to be short to less than a predetermined value shorter than the upper limit L1 (m) of the guaranteed job length MLBD, causing the cleaning interval to be shortened. This can contribute to the suppression of the nozzle clogging in the discharge unit 28. This is effective as a countermeasure to suppress nozzle clogging, although reducing the productivity.

Figure 8:
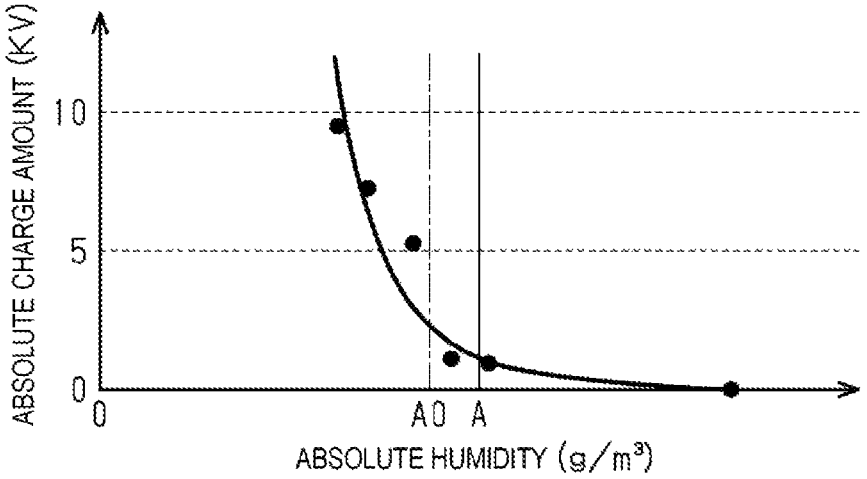
FIG. 8 is a graph illustrating a relationship between absolute humidity and chargeability of foreign substances.

FIG. 8 illustrates an evaluation test result that clarifies the lower limit value A of the printing environment appropriate region HA illustrated in FIG. 7. In the graph illustrated in FIG. 8, the horizontal axis is absolute humidity (g/m^3), and the vertical axis is absolute charge amount (KV). Samples of materials assuming various foreign substances are prepared, and evaluation tests are conducted to evaluate the easiness of charging for each of the samples. The sample is, for example, a rectangular parallelepiped with a predetermined size of 1 to several cm cube. The sample is charged by applying a predetermined voltage (for example, 20 KV) within the range from 10 to 30 KV. The sample after being charged is left until basically completely discharged under an atmosphere of absolute humidity. The absolute charge amount (KV) is measured, by placing the probe against the sample, a plurality of times with respect to the time elapsed. The measurement results in case when the sample is a cotton match the characteristics of the typical foreign substances. FIG. 8 illustrates the absolute charge amount with respect to the absolute humidity at a predetermined time when the measurement is conducted in case when the sample is a cotton. The predetermined time is a time when a predetermined period of time (for example, 20 seconds) elapsed within the range from 10 to 30 seconds, for example. In the range from A0 (g/cm^3) or higher of the absolute humidity, the absolute charge amount is significantly reduced. That is, it can be recognized that the sample is hardly charged in the range from A0 (g/cm^3) or higher of the absolute humidity. In this example, an absolute humidity A (g/cm^3) that the absolute humidity is A0 (g/cm^3) or higher and the guaranteed job length MLBD can be set to L1 (m) or greater is the lower limit value of the printing environment appropriate region HA.

Note that the upper limit value B (g/cm^3) is determined by conducting a printing evaluation test on the presence or absence of wrinkles that occur in the medium 99 under various absolute humidity conditions. In the printing evaluation test, under the various absolute humidity conditions, printing is performed on the medium 99 under a predetermined printing condition under which the wrinkles 99S easily occur. The presence or absence of the wrinkles 99S is visually observed for the medium 99 being printed, and the absolute humidity under which the wrinkles 99S do not occur is added with a predetermined margin and is set to the upper limit value B (g/cm^3) of the printing environment appropriate region HA.

The control unit 70, when the humidity detection unit 53 detects a humidity less than the lower limit value A, causes the humidifier 54 or the drying device 40 in the humidification mode to humidify the interior of the housing 12 during transport of the transport unit 14 or during discharge of the discharge unit 28. Here, during transport of the transport unit 14 or during discharge of the discharge unit 28 refers to during execution of the printing operation based on the job PJ. When using the humidifier 54, the control unit 70 may start humidifying the interior of the housing 12 in a period before the start of the printing operation, and, for example, when or after receiving the job PJ. Note that in the first embodiment, the lower limit value A corresponds to one example of the first predetermined value.

Further, the control unit 70, when the transport amount of the medium 99 transported by the transport unit 14 is not less than a predetermined value PL2 (m) until the job PJ executed by the discharge unit 28 and the transport unit 14 is completed after the humidity detection unit 53 detects a humidity less than the lower limit value A, causes the humidifier 54 to humidify the interior of the housing 12, while when the transport amount is less than the predetermined value PL2 (m), does not perform humidification. Note that in the first embodiment, the predetermined value PL2 corresponds to one example of the second predetermined value.

In addition, the control unit 70, when the transport amount of the medium 99 transported by the transport unit 14 is less than the predetermined value PL2 (m) until the job PJ is completed after the humidity detection unit 53 detects a humidity less than the first predetermined value, changes the time to execute the discharge maintenance operation of the discharge unit 28 to before the start or after the termination of the job PJ.

The control unit 70, when the liquid amount per unit area of the liquid discharged from the discharge unit 28 to the medium 99 is less than the predetermined value LV3 at the time when the humidity detection unit 53 detects a humidity less than the lower limit value A, causes the humidifier 54 to humidify the interior of the housing 12, while when the liquid amount per unit area is not less than the predetermined value LV3, does not perform humidification. Note that in the first embodiment, the predetermined value LV3 corresponds to one example of the third predetermined value.

The control unit 70, when the humidity detection unit 53 detects a humidity exceeding the upper limit value B and when the liquid amount per unit area of the liquid discharged from the discharge unit 28 is less than a predetermined value LV5, lowers the temperature of the drying device 40 during transport of the transport unit 14 or during discharge of the discharge unit 28. Note that in the first embodiment, the upper limit value B corresponds to one example of the fourth predetermined value. In addition, the predetermined value LV5 corresponds to one example of the fifth predetermined value.

Further, the control unit 70, when the diameter of the roll body 102, which is the diameter of the medium 99 in a rolled form at the time when the humidity detection unit 53 detects a humidity exceeding the upper limit value B, is not less than the predetermined value WD6, intensifies a force applied to the medium 99 in a direction approximating the medium 99 to the support portion 22. In this example, the control unit 70 increases the negative pressure of the suction mechanism 30 to intensify, by a suction force, the force applied to the medium 99 in the direction approximating the medium 99 to the support portion 22. Further, when the liquid discharge apparatus 11 is a textile printing machine, the control unit 70 enhances the pressing force of the pasting roller, to thus intensify the force applied to the medium 99 in the direction approximating the medium 99 to the support portion 22.

In addition, the control unit 70, when the diameter of the roll body 102, which is the diameter of the medium 99 in a rolled form at the time when the humidity detection unit 53 detects a humidity exceeding the upper limit value B, is less than the predetermined value WD6, weakens the winding force applied to the medium 99 by the winding unit 17. Note that in the first embodiment, the predetermined value WD6 corresponds to one example of the sixth predetermined value.

Next, the action of the liquid discharge apparatus 11 will be described below. The foreign substances FM adhering to the medium 99 and the foreign substances FM suspended in the air intrude into the housing 12 through the feeding port 12A. The foreign substances FM intruded into the housing 12 are positively or negatively charged. The discharge unit 28, which is at an electrical potential of 0 V, facilitates the foreign substances FM that is charged to adhere to the nozzle opening surface 28B. The foreign substances FM adhering to the nozzle opening surface 28B induces nozzle clogging. Note that the nozzle clogging refers to a phenomenon that droplets cannot be normally discharged, and includes, in addition to the phenomenon that a liquid cannot be discharged, a phenomenon that the amount of discharging the liquid is less than the amount at normal time.

Incidentally, the amount of the foreign substances FM suspended in the air varies depending on the absolute humidity. When the absolute humidity is low, the foreign substances FM are easily suspended in the air. Thus, the amount of the foreign substances FM suspended in the air increases. On the other hand, when the absolute humidity is high, the foreign substances FM contain moisture and are less likely to be suspended in the air. Thus, the amount of the foreign substances FM suspended in the air decreases. When the absolute humidity is low as such, a nozzle clogging in the discharge unit 28 easily occurs. Accordingly, printing in an environment where the absolute humidity is not less than the lower limit value A is recommended.

On the other hand, when the humidity is high, the medium 99 absorbs the moisture in the air, and the moisture content of the medium 99 is high. When the moisture content of the medium 99 before performing printing is high, the total moisture content of the medium 99, which is the sum with the moisture in the liquid discharged to the medium 99, is high, facilitating the occurrence of the wrinkles 99S and floating of the medium 99, and moreover, causing the medium 99 to be hardly dried. Accordingly, in the first embodiment, printing in an environment in which the absolute humidity is not greater than the upper limit value B is recommended.

The user operates the operation unit 170 of the host apparatus 150 or the operation unit 74 of the liquid discharge apparatus 11 to input and set the printing condition information. For example, the user performs nesting to connect a plurality of images, to create one set of the job PJ. The user also sets the number of times of printing by which the one set of the job PJ is repeatedly executed. The user further sets the set temperature of the heaters 31 to 33, the heating temperature and the blowing air volume of the drying device 40, and the ventilation air volume of the fan 51. The printing condition information contains medium size, medium type, print color, job length, number of times of printing, total job length, heater temperature, heating temperature, blowing air volume, ventilation air volume, and the like.

The user causes the medium 99 drawn from the roll body 101 loaded on the feeding unit 15 to be nipped by the rollers 25 and 26 to set the medium 99 on the transport unit 14. Before the start of the printing operation, a preparatory operation is performed for the liquid discharge apparatus 11 until the drying device 40 is heated to a target temperature. The user also operates the operation unit 170 of the host apparatus 150 or the operation unit 74 of the liquid discharge apparatus 11 to instruct the control unit 70 to perform the reel measurement. In the reel measurement, a motor load is measured when the medium 99 is transported under a state where no tension is being exerted on the medium 99. The motors 19 and 77 are then controlled for the motor load to apply a predetermined front tension to the medium 99. The motors 16 and 77 are also controlled to apply a predetermined back tension to the medium 99. This allows the medium 99 to be applied with a suitable tension. Note that the dust catcher 55 is installed only when necessary because the sliding resistance due to the sliding against the printed surface 99A causes the back tension to be greater than a suitable value, which causes an influence on the printing position accuracy.

The control sequence executed by the control unit 70 will be described below. The control unit 70, after the liquid discharge apparatus 11 is powered on, executes the control sequence illustrated in the flowchart in FIG. 9.

First, in step S11, the control unit 70 acquires an absolute humidity. The control unit 70 acquires the absolute humidity AH detected by the humidity detection unit 53. Alternatively, the control unit 70 may execute a predetermined calculation based on the relative humidity RH detected by the humidity sensor 75 configuring the humidity detection unit 53 and the temperature T (° C.) detected by the temperature sensor 76 to acquire the absolute humidity AH. Note that in the first embodiment, the processing in step S11 corresponds to an example of the "humidity detection step".

In step S12, the control unit 70 determines whether the absolute humidity is less than the lower limit value A. When the absolute humidity AH is less than the lower limit value A, the process proceeds to step S13, while when the absolute humidity AH is not less than the lower limit value A, that is, equal to or greater than the lower limit value A, the process proceeds to step S17.

In step S13, the control unit 70 determines whether the length of the job is less than the predetermined value PL2. When the length of the job is less than the predetermined value PL2, the control unit 70 proceeds to step S14, while when the length of the job is not less than the predetermined value PL2, the control unit 70 proceeds to step S15. When the transport amount of the medium 99 transported by the transport unit 14 is less than the predetermined value PL2 (m) until the job PJ executed by the discharge unit 28 and the transport unit 14 is completed after the humidity detection unit 53 detects a humidity less than the lower limit value A, the process proceeds to step S14, while when the transport amount is not less than the predetermined value PL2 (m), the process proceeds to step S16. Note that the predetermined value PL2 is a value corresponding to the print length to be printed until the next discharge maintenance operation is executed. The predetermined value PL2 corresponds, when it is before the start of the execution of the job PJ, to the print length that is printed at a predetermined printing speed during the execution interval time of the discharge maintenance operation. The predetermined printing speed is a print speed employed during the execution of the job PJ.

In step S14, the control unit 70 performs adjustment of the time of the discharge maintenance operation. That is, the control unit 70 performs adjustment of the time of the discharge maintenance operation that the maintenance device 56 performs cleaning of the nozzles 28A of the discharge unit 28. The control unit 70 changes the time of the discharge maintenance operation to before the start or after the termination of the job PJ, which has the job length less than the predetermined value PL2. That is, the time of the discharge maintenance operation is changed to after the termination of the job PJ at present or before the job PJ of the next is started. This advances the time to execute the next discharge maintenance operation. In this way, the execution interval of the discharge maintenance operation executed by the maintenance device 56 is adjusted to be early time in accordance with the job length. Accordingly, when the absolute humidity AH is less than the lower limit value A, the advancing of the time to execute the discharge maintenance operation makes it possible to suppress the occurrence of nozzle clogging.

In step S15, the control unit 70 determines whether the discharge amount is less than the predetermined value LV3. The discharge amount herein referred to is a discharge amount per unit area. The control unit 70 causes the liquid discharge amount acquisition unit 82 to acquire the discharge amount per unit area. The liquid discharge amount acquisition unit 82 calculates the total liquid amount discharged in one image based on the image data contained in the job PJ and divides the total liquid amount by the medium area to which the image is to be printed, to acquire the discharge amount of the liquid per unit area, that is, the liquid amount per unit area. Here, the predetermined value LV3 indicates a discharge amount per unit area that is small not to adversely affect the drying of the medium 99 even when humidifying the interior of the housing 12. The control unit 70 determines whether the discharge amount is less than 5 g/m^2, for example. When the discharge amount is less than the predetermined value LV3, the control unit 70 proceeds to step S16, while when the discharge amount is not less than the predetermined value LV3, the control unit 70 terminates the routine. Here, when the discharge amount is less than the predetermined value LV3, the medium 99 to which the liquid is discharged is easily dried. Thus, there is no issue even if humidification is performed to some extent. However, when the discharge amount is not less than the predetermined value LV3, the medium 99 to which the liquid has been discharged is hardly dried when humidification is performed, and there is a concern in that drying of the medium 99 is inhibited. Note that in step S15, the control unit 70 may determine whether the printed image pattern is a specific pattern that can be deemed as a solid pattern, in addition to determining whether the discharge amount is less than the predetermined value LV3. Here, the specific pattern indicates a pattern in which the occupancy of the liquid adhesion area with respect to the area of the region to be printed on the medium 99 is 80% or greater. For example, the solid pattern satisfies the condition of the specific pattern. In this case, the control unit 70 proceeds to step S16 when the discharge amount is less than the predetermined value LV3 and is not the specific pattern, and otherwise terminates the routine.

Note that when the discharge amount per unit area is not less than the predetermined value LV3, the control unit 70 drives the fan 51 to continuously generate the second airflow AF2, to thus ventilate the interior of the housing 12 with a clean air, removing the foreign substances FM suspended in the air inside the housing 12. That is, the fan 51 is driven to cause the clean air filtered through the filter 52 to be taken into the housing 12 through the intake port 12C at the upper portion of the housing 12, and the second airflow AF2 being clean that is thus taken in flows at the periphery of the discharge unit 28 and is then mainly discharged through the exhaust port 12B of the feeding port 12A and the exhaust port 12B, thus removing the foreign substances FM suspended in the air from the periphery of the discharge unit 28. This makes it possible to suppress nozzle clogging due to the foreign substances FM adhering to the discharge unit 28.

In step S16, the control unit 70 humidifies the interior of the housing 12. The control unit 70 humidifies the interior of the housing 12 by one of the two methods. One method is that the humidifier 54 provided inside the housing 12 is driven. The humidifier 54 converts water in the water reservoir section into mist or moisture vapor. The other method is that the drying device 40 is caused to heat the medium 99 under a state where the fans 45 and 51 are stopped. The third airflow AF3, which includes moisture vapor evaporated from a liquid by heating the medium 99, flows upward by a chimney effect between the drying device 40 and the downstream support portion 23 and flows into the housing 12 through the exhaust port 12B. This allows the interior of the housing 12 to be humidified. Here, the fan 51 may be driven with a small blowing air volume that does not inhibit the third airflow AF3 from flowing into the housing 12. In this case, the second airflow AF2, which is generated when the fan 51 takes clean air into the housing 12, is mainly exhausted through the feeding port 12A, and the interior of the housing 12 is ventilated with the second airflow AF2. Note that in the first embodiment, the processing in step S16 corresponds to one example of the "humidification step".

While printing is performed where the job PJ is being executed, the control unit 70 controls the transport unit 14 and the discharge unit 28 to perform the transport operation of transporting the medium 99 by the transport unit 14 or the discharge operation of discharging liquid by the discharge unit 28. The control unit 70 performs the processings in steps S12 and S16, to cause, when the humidity detection unit 53 detects a humidity less than the lower limit value A, the humidifier 54 to humidify the interior of the housing 12 during transport of the transport unit 14 or during performing printing, that is, during discharge of the discharge unit 28.

The control unit 70 also performs the processings in step S12, S13, and S16 to perform the following control. In other words, the control unit 70, when the transport amount of the medium 99 transported by the transport unit 14 is not less than the predetermined value PL2 (m) until the job PJ executed by the transport unit 14 and the discharge unit 28 is completed after the humidity detection unit 53 detects a humidity less than the lower limit value A, causes the humidifier 54 to humidify the interior of the housing 12, while when the transport amount is less than the predetermined value PL2 (m), does not perform humidification. When the humidity detection unit 53 detects the absolute humidity AH less than the lower limit value A during printing (positive determination in step S12), the control unit 70 determines the predetermined value PL2 to be used during printing. The control unit 70 calculates the print length that can be printed at a predetermined printing speed during the execution interval time of the discharge maintenance operation, which is set when the absolute humidity AH is within a suitable humidity range. This is set as an allowable print length. The control unit 70 subtracts the print length, over which printing is so far performed at the predetermined print speed by the job PJ being executed that is started at or after the time point of performing the previous discharge maintenance operation, from the allowable print length, and determines the remaining allowable print length that is allowed until the time point of performing the next discharge maintenance operation. The remaining allowable print length is referred to as the predetermined value PL2. Then, in step S13, the control unit 70 determines whether the remaining allowable print length of the job PJ being executed is less than the predetermined value PL2. If the control unit 70 continues the remaining printing operation beyond the predetermined value PL2, the possibility of the occurrence of nozzle clogging becomes high. Accordingly, when the remaining print length of the job PJ being executed is not less than the predetermined value PL2, the interior of the housing 12 is humidified to reduce the amount of the foreign substances FM suspended in the air inside the housing 12, to thus suppress the occurrence of printing failure caused by nozzle clogging even if performing printing of a scheduled job length. It goes without saying that the control unit 70 may change the job length set by the user to be short to cope with the printing failure, however, it is not favorable to change the job length set by the user, and thus the interior of the housing 12 is humidified to suppress the occurrence of nozzle clogging while prioritizing the performing of printing of the job length set by the user.

On the other hand, when the remaining print length of the job PJ is less than the predetermined value PL2 (positive determination in step S13), the time to execute the discharge maintenance operation is adjusted without humidifying the interior of the housing 12. Here, humidifying the interior of the housing 12 increases the moisture content of the medium 99 before performing printing, increases the amount of expansion and contraction during the drying process of the medium 99 after performing printing, and facilitates the occurrence of the wrinkles 99S. Accordingly, when the remaining print length of the job PJ is short, which is less than the predetermined value PL2, and the time to execute the discharge maintenance operation can be advanced without performing a discharge maintenance operation in the middle of the job, the control unit 70 changes the time to execute the discharge maintenance operation to before the start or after the termination of the job PJ. That is, the control unit 70, when the transport amount of the medium 99 transported by the transport unit 14 until the job PJ is completed is less than the predetermined value PL2, changes the time to execute the discharge maintenance operation of the discharge unit 28 to before the start or after the termination of the job PJ.

In addition, the control unit 70, when the liquid amount per unit area of the liquid discharged from the discharge unit 28 is less than the predetermined value LV3 at the time when the humidity detection unit 53 detects the absolute humidity AH less than the lower limit value A, the discharge amount is originally small and the wrinkles 99S do not easily occur even if humidification is performed to some extent, uses one or both of the two types of humidifying units to humidify the interior of the housing 12. Humidifying the interior of the housing 12 makes it possible to suppress the occurrence of nozzle clogging. On the other hand, the control unit 70, when the liquid amount per unit area is not less than the predetermined value LV3, the discharge amount is originally large and the wrinkles 99S easily occur, does not perform a humidification that advances the occurrence of the wrinkles 99S.

Note that when the discharge amount per unit area is less than the predetermined value LV3, the control unit 70, upon confirming that the dust catcher 55 is installed by the mounting signal, may drive a movable member to deform the dust catcher 55 in the direction of pressing the dust catcher 55 against the printed surface 99A, to ensure a large sliding surface area between the dust catcher 55 and the printed surface 99A. Enlarging the sliding surface area between the dust catcher 55 and the printed surface 99A enhances the effect of suppressing foreign substances from intruding into the housing 12.

On the other hand, in step S17, the control unit 70 determines whether the absolute humidity exceeds the upper limit value B. When the absolute humidity AH exceeds the upper limit value B, the process proceeds to step S18, while when the absolute humidity is not greater than the upper limit value B, the control unit 70 terminates the routine. That is, when the absolute humidity AH falls within the printing environment appropriate region HA, the control unit 70 terminates the routine. Note that in the first embodiment, the processings in steps S11 and S17 correspond to one example of the "first determination step".

In step S18, the control unit 70 determines whether the medium 99 is of a specific medium type. Specifically, the medium type determination unit 81 determines whether the medium 99 is of a specific medium type. Here, the specific medium type refers to the medium 99 such as a paper of thin thickness. For example, the specific medium type refers to a medium such as a thin paper with basis weight of 90 g/m^2 or less. In case of the thin paper, the liquid content ratio, which is the ratio of the amount of a liquid such as ink occupying in the volume of the medium 99 is high. Thus, the wrinkles 99S easily occur due to the large amount of expansion and contraction when the medium 99 expands and contracts in the drying process. When the medium 99 is of the specific medium type, the control unit 70 proceeds to step S19, while when not of the specific medium type, the control unit 70 terminates the routine.

In step S19, the control unit 70 determines whether the discharge amount is less than the predetermined value LV5. The discharge amount herein referred to is a discharge amount per unit area, for example. The control unit 70 causes the liquid discharge amount acquisition unit 82 to acquire the discharge amount per unit area. The predetermined value LV5 is, for example, a value less than 10 g/m^2. When the discharge amount is less than the predetermined value LV5, the control unit 70 proceeds to step S20, while when the discharge amount is not less than the predetermined value LV5, the control unit 70 proceeds to step S21. In addition, in step S19, the control unit 70 may determine whether the printed image pattern is a specific pattern that can be deemed as a solid pattern, in addition to determining whether the discharge amount is less than the predetermined value LV5. Here, the specific pattern is the same as that described in the determination of step S15. In this case, the control unit 70 may proceed to step S21 after raising the heater temperature, when the discharge amount is not less than the predetermined value LV5 and the printed image pattern is the specific pattern. Note that in the first embodiment, the processing in step S19 corresponds to one example of the "second determination step".

In step S20, the control unit 70 lowers the heater temperature. When the medium 99 is of the specific medium type, the medium 99 to which only the liquid discharged at the discharge amount of less than the predetermined value LV5 adheres, when heated at a prescribed heat-set temperature, contracts greatly, facilitating the occurrence of the wrinkles 99S. Accordingly, the heater temperature is lowered to suppress the occurrence of the wrinkles 99S due to the drying shrinkage of the medium 99. Here, the heating unit for which the heater temperature is to be lowered is the drying device 40. The control unit 70 lowers the heat-set temperature of the heater tube 41 of the drying device 40. In this way, the control unit 70, when the humidity detection unit 53 detects a humidity exceeding the upper limit value B and when the liquid amount per unit area of the liquid discharged from the discharge unit 28 is less than the predetermined value LV5, lowers the temperature of the drying device 40 during printing operation, for example. Further, the heating unit for which the heater temperature is to be lowered may be the heaters 31 to 33, in addition to the drying device 40. The heating unit may be any one, any two, any three, or all of the drying device 40 and the heaters 31 to 33. In particular, it is preferred that the heat-set temperature of one or both of the drying device 40 and the after-heater 33 be lowered. Further, the lowering of the heater temperature is not limited to reducing the amount of current supplied to the heater, and may include a lowering of the temperature that does not energize the heater, that is, the heater temperature is lowered to the room temperature, for example. Note that in the first embodiment, the processing in step S20 corresponds to one example of the "heating control step".

While when the absolute humidity AH exceeds the upper limit value B and the liquid amount per unit area of the liquid is not less than the predetermined value LV5, the moisture content of the medium 99 is high before performing printing. Thus, the total moisture content of the medium 99 to which the liquid has been discharged is high, and is less prone to drying. Accordingly, the heating is performed at the heat-set temperature. However, the medium 99 to which the liquid has been discharged at the predetermined value LV5 or greater easily swells and largely expands, and greatly contracts during the subsequent drying process in which the medium 99 is heated at the normal heat-set temperature. Accordingly, the medium 99 having a large amount of liquid adhered when performing printing easily causes the wrinkles 99S to occur.

In step S26, the control unit 70 determines whether the roll diameter is less than the predetermined value WD6. The control unit 70 acquires the roll diameter of the roll body 102 at present from the roll diameter measuring unit 83. When the roll diameter is less than the predetermined value WD6, the control unit 70 proceeds to step S22, while when the roller diameter is not less than the predetermined value WD6, the control unit 70 proceeds to step S23. Here, when the roll diameter of the roll body 102 is not less than the predetermined value WD6, a lateral displacement easily occurs between the layers in the medium 99 wound in a plurality of layers in a rolled form. As such, the predetermined value WD6 corresponds to the minimum value of the roll diameter that causes the lateral displacement to occur. The user occasionally set the total job length to be long, in order to enhance the productivity during unmanned operation, for example. For example, the user sets the total job length to be long, by setting a large number of times of printing for repeatedly performing printing one job or a plurality of jobs. When the total job length is set to be long, the diameter of the roll body 102 wound around the winding unit 17 becomes large, and when the diameter becomes not less than the predetermined value WD6, a lateral displacement of the medium 99 easily occurs. In the unmanned operation, the user is not allowed to change the total job length in the middle, and it is unfavorable for the control unit 70 to reduce the job length and the number of times of printing set by the user without permission. It is also effective to reduce the tension of the medium 99 exerted on the medium 99 in order to suppress the occurrence of the wrinkles 99S. However, when the absolute humidity AH exceeds the upper limit value B, there is a circumstance where the wrinkles 99S easily occur. Thus, if the tension of the medium 99 is reduced when the roll diameter is not less than the predetermined value WD6, the lateral displacement of the medium 99 is unfavorably facilitated in exchange with the suppression of the wrinkles 99S.

In step S22, the control unit 70 reduces the winding force. Specifically, the control unit 70 performs control to reduce the rotational speed or rotational torque of the winding motor 19, to thus reduce the winding force. By thus reducing the winding force, the front tension exerted on the medium 99 is reduced at the portion between the transport unit 14 and the winding unit 17. This makes it possible to suppresses the occurrence of the wrinkles 99S in the medium 99. Note that in step S22, the control unit 70, in place of the front tension or in addition to the front tension, may control the feeding motor 16 to reduce the back tension exerted on the medium 99 at the portion between the feeding unit 15 and the transport unit 14.

In step S23, the control unit 70 increases the suction force. Here, when the roll diameter is not less than the predetermined value WD6, a lateral displacement easily occurs between the layers in the medium 99 wound in a plurality of layers in a rolled form. Here, when the winding force is reduced to reduce the tension exerted on the medium 99, the lateral displacement of the medium 99 is unfavorably facilitated in exchange with the suppression of the wrinkles 99S. Accordingly, when the diameter of the roll body 102, which is the diameter of the medium 99 in a rolled form, is not less than the predetermined value WD6, the force applied to the medium 99 in the direction approximating the medium 99 to the support portion 22 is intensified. That is, in case of the state when no force is applied so far in the direction approximating the medium 99 to the support portion 22 to a portion of the medium 99 supported by the support portion 22, a force is applied in the direction approximating the medium 99 to the support portion 22, or when a force has been already applied so far in the direction approximating the medium 99 to the support portion 22, the force is changed to a greater force.

The force applying unit configured to apply a force to the medium 99 in the direction approximating the medium 99 to the support portion 22 is the suction mechanism 30 in the first embodiment. The suction mechanism 30, if having not been driven so far, drives the exhaust fan 38, or if having already been driven, increases the rotational frequency of the exhaust fan 38, to thus enhance the suction force that suctions the medium 99 toward the support surface 22A. This suction force causes a force in the direction approximating the medium 99 to the support portion 22 to be applied to the medium 99. Further, when the liquid discharge apparatus 11 is a textile printing machine, the control unit 70 enhances the pressing force of the pasting roller, to thus apply a force in the direction approximating the medium 99 to the support portion 22 to the medium 99. As such, when the absolute humidity AH exceeds the upper limit value B and the roll diameter is not less than the predetermined value WD6, the occurrence of the wrinkles 99S and the like in the medium 99 is suppressed without facilitating the lateral displacement in the roll body 102.

As described above in detail, according to the first embodiment, the following advantageous effects can be achieved.

(1) When the humidity detection unit 53 detects a humidity less than the lower limit value A (one example of the first predetermined value), the interior of the housing 12 is humidified by the humidifier 54 or the drying device 40 (one example of the humidifying unit) in the humidification mode during transport of the transport unit 14 or during discharge of the discharge unit 28. Thus, humidifying the interior of the housing 12 makes it possible to suppress the nozzle clogging in the discharge unit 28 due to the foreign substances such as dust and fluff that are easily suspended in the air when the humidity is low, which is less than the lower limit value A. Thus, even when the humidity falls below a suitable range, the occurrence of nozzle clogging in the discharge unit 28, which is the failure cause of disqualifying the printed material being a product, is suppressed. In JP 2015-178179 A, the easiness of the occurrence of nozzle clogging is not reduced, but the nozzle clogging is prevented by increasing the frequency of performing the discharge maintenance operation. This allows waste ink consumption to increase, and moreover, the discharge maintenance operation to increase, thus reducing the productivity. In contrast, in the first embodiment, the frequency of performing the discharge maintenance operation is not necessarily increased, which does not reduce the productivity without increasing the ink consumption as well.

(2) When the transport amount of the medium 99 transported by the transport unit 14 is not less than the predetermined value PL2 (one example of the second predetermined value) until the job PJ executed by the discharge unit 28 and the transport unit 14 is completed after the humidity detection unit 53 detects a humidity less than the lower limit value A, the interior of the housing 12 is humidified by the humidifier 54 or the drying device 40 in the humidification mode. While when the transport amount is less than the predetermined value PL2, humidification is not performed. Thus, when the transport amount of the medium 99 until the job PJ is completed is long, which is not less than the predetermined value PL2, the interior of the housing 12 is humidified to suppress the nozzle clogging in the discharge unit 28. Further, when the transport amount of the medium 99 until the job PJ is completed is less than the predetermined value PL2, unnecessary humidification of the interior of the housing 12 can be avoided. For example, this makes it possible to avoid the medium 99 to which the liquid is discharged from becoming less prone to drying due to the unnecessary humidification. This makes it possible to avoid wrinkles from occurring due to the unnecessary humidification, because the medium 99, which is less prone to drying, also causes wrinkles to occur in the medium 99.

(3) When the transport amount of the medium 99 transported by the transport unit 14 is less than the predetermined value PL2 until the job PJ is completed after the humidity detection unit 53 detects the humidity less than the lower limit value A, the time to execute the discharge maintenance operation of the discharge unit 28 is changed to before the start or after the termination of the job PJ. Thus, even in an environment where the humidity is less than the lower limit value A and the foreign substances such as dust and fluff are easily suspended in the air, the advancing of the time to execute the discharge maintenance operation makes it possible to suppress the occurrence of nozzle clogging in the discharge unit 28.

(4) When the liquid amount per unit area of the liquid discharged from the discharge unit 28 is less than the predetermined value LV3 (one example of the third predetermined value) at the time when the humidity detection unit 53 detects a humidity less than the lower limit value A, the interior of the housing 12 is humidified by the humidifier 54 or the drying device 40 in the humidification mode, while when the liquid amount per unit area is not less than the predetermined value LV3, humidification is not performed. In the interior of the housing 12, the liquid discharged to the medium 99 evaporates to increase the humidity inside the housing 12. When the liquid amount per unit area of the liquid is small, which is less than the predetermined value LV3, the interior of the housing 12 is humidified to a small degree even by the evaporation of the liquid. Thus, the interior of the housing 12 is humidified by the humidifier 54 or the drying device 40 in the humidification mode. While when the liquid amount per unit area of the liquid is large, which is not less than the predetermined value LV3, the interior of the housing 12 is humidified to a large degree by the evaporation of the liquid. Thus, the interior of the housing 12 is not humidified. Thus, the nozzle clogging in the discharge unit 28 can be suppressed, as well as the occurrence of the wrinkles 99S caused by insufficient drying of the medium 99 due to the interior of the housing 12 being unnecessarily humidified, and a swelling of the medium 99 due to the liquid can be avoided.

(5) When the humidity detection unit 53 detects a humidity exceeding the upper limit value B (one example of the fourth predetermined value) and when the liquid amount per unit area of the liquid discharged from the discharge unit 28 is less than the predetermined value LV5 (one example of the fifth predetermined value), the temperature of the drying device 40 is lowered during transport of the transport unit 14 or during discharge of the discharge unit 28. Thus, when the humidity detection unit 53 detects a humidity exceeding the upper limit value B and when the liquid amount per unit area of the liquid discharged from the discharge unit 28 is less than the predetermined value LV5, the temperature of the drying device 40 lowers during transport of the transport unit 14 or during discharge of the discharge unit 28. Even when the humidity is high to exceed the upper limit value B, the medium 99 to which the liquid is discharged is easily dried when the liquid amount per unit area of the liquid discharged to the medium 99 is small, which is less than the predetermined value LV5, which may cause the medium 99 to contract due to the heat from the drying device 40. The lowering of the temperature of the drying device 40 makes it possible to suppress the contraction of the medium 99 due to heat and to suppress the occurrence of the wrinkles 99S. Thus, even when the humidity falls above a suitable range, the occurrence of the wrinkles 99S and floating, which is the failure cause of disqualifying the printed material being a product, is suppressed. This makes it possible to reduce the printing failure due to the wrinkles 99S and floating occurred in the medium 99.

(6) The liquid discharge apparatus 11 further includes the winding unit 17 configured to wind the medium 99, to which the liquid is discharged from the discharge unit 28, in a rolled form, and the suction mechanism 30 (one example of the force applying unit) configured to apply a force in the direction approaching the support portion 22 to a portion of the medium 99, which is supported by the support portion 22. When the diameter of the medium 99 in a rolled form is not less than the predetermined value WR6 (one example of the sixth predetermined value) at the time when the humidity detection unit 53 detects a humidity exceeding the upper limit value B, a force applied to the medium 99 in the direction approximating the medium 99 to the support portion 22 is intensified. Thus, when the diameter of the medium 99 in a rolled form is not less than the predetermined value WD6 at the time when the humidity detection unit 53 detects a humidity exceeding the upper limit value B, a force in the direction approximating the medium 99 to the support portion 22 is applied to a portion of the medium 99, which is supported by the support portion 22, or the force is changed to the larger force side. When the humidity exceeds the upper limit value B, the tension exerted on the medium 99 is reduced to suppress the occurrence of the wrinkles 99S. However, when the roll diameter that is the diameter of the medium 99 in a rolled form is large, which is not less than the predetermined value WD6, reducing the tension exerted on the medium 99 is unfavorable in that the lateral displacement of the medium 99 in the roll body 102 is facilitated. The force applied to a portion of the medium 99, which is supported by the support portion 22, in the direction approximating the medium 99 to the support portion 22 is intensified to suppress the wrinkles 99S and floating of the medium 99.

(7) The liquid discharge apparatus 11 further includes the winding unit 17 configured to wind the medium 99, to which the liquid is discharged from the discharge unit 28, in a rolled form. When the diameter of the medium 99 in a rolled form is less than the predetermined value WD6 at the time when the humidity detection unit 53 detects a humidity exceeding the upper limit value B, the winding force applied to the medium 99 by the winding unit 17 is weakened. Thus, when the diameter of the medium 99 in a rolled form is less than the predetermined value WD6 at the time when the humidity detection unit 53 detects a humidity exceeding the upper limit value B, the winding force applied to the medium 99 by the winding unit 17 is weakened. Even when the humidity is high to exceed the upper limit value B, the winding force of the winding unit 17 when winding the medium 99 is weakened because the winding displacement hardly occurs when the diameter of the medium 99 in a rolled form is small, which is less than the predetermined value WD6. Thus, the tension (front tension) exerted on the portion of the medium 99 to which the liquid is discharged is suppressed to a small degree, which prevents the wrinkles from occurring in the medium 99.

(8) Provided is a method for controlling a liquid discharge apparatus including the transport unit 14 configured to transport the medium 99, the discharge unit 28 configured to discharge a liquid to the medium 99, the housing 12 including the discharge unit 28 inside the housing 12, the humidifier 54 or the drying device 40 in the humidification mode configured to humidify the interior of the housing 12, and the humidity detection unit 53 configured to detect a humidity. The controlling method includes a humidity detection step for detecting a humidity by the humidity detection unit 53 (step S11), and a humidification step in which when the humidity detection unit 53 detects a humidity less than the first predetermined value, the interior of the housing 12 is humidified by the humidifier 54 or the drying device 40 in the humidification mode during transport of the transport unit 14 or during discharge of the discharge unit 28 (step S16). Thus, according to the controlling method, the same advantageous effect as the advantageous effect of the above-described item (1) is achieved.

(9) Provided is a method for controlling a liquid discharge apparatus including the transport unit 14 configured to transport the medium 99, the discharge unit 28 configured to discharge a liquid to the medium 99, the housing 12 including the discharge unit 28 inside the housing 12, the drying device 40 configured to heat the medium 99 to which the liquid is discharged from the discharge unit 28, and the humidity detection unit 53 configured to detect a humidity. The controlling method includes a first determination step for determining whether the humidity detection unit 53 has detected a humidity exceeding the fourth predetermined value (steps S11 and S17), and a second determination step for determining whether the liquid amount per unit area of the liquid discharged from the discharge unit 28 is less than the predetermined value LV5 (step S19). Moreover, the control method includes a heating control step in which when the humidity detection unit 53 detects a humidity exceeding the upper limit value B and when the liquid amount per unit area of the liquid discharged from the discharge unit 28 is less than a predetermined value LV5, the temperature of the drying device 40 is lowered during transport of the transport unit 14 or during discharge of the discharge unit 28 (step S20). Thus, according to the controlling method, the same advantageous effect as the advantageous effect of the above-described item (5) is achieved.

Note that the above-described embodiments may also be modified as embodiments in the following modifications. Further, the combinations as appropriate of the above-described embodiments and the modifications described below can be further modifications, and the combinations as appropriate of the modifications described below can be further modifications.

In the above-described embodiments, the interior of the housing 12 may be humidified when the processings in step S13 and step S15 are omitted and when in step S12, the humidity detection unit 53 detects an absolute humidity less than the lower limit value A. Further, one of the processings in step S13 and step S15 may be omitted. That is, the interior of the housing 12 may be humidified when the job length is less than the predetermined value in case when the humidity detection unit 53 detects an absolute humidity less than the lower limit value A, or the interior of the housing 12 may be humidified when the discharge amount per unit area is less than the predetermined value in case when the humidity detection unit 53 detects an absolute humidity less than the lower limit value A.

In the above-described embodiments, the interior of the housing 12 may be humidified every time when the humidity detection unit 53 detects an absolute humidity less than the lower limit value A. That is, humidification may be performed even when the length of the job PJ is less than the predetermined value PL2, and humidification may be performed even when the discharge amount per unit area is not less than the predetermined value LV3. Further, humidification may not be performed when the length of the job PJ is less than the predetermined value PL2, and humidification may be performed, regardless of the value of the discharge amount, when the length of the job PJ is not less than the predetermined value.

In the above-described embodiments, when the processings in step S18 and step S21 are omitted and in step S17, the humidity detection unit 53 detects an absolute humidity exceeding the upper limit value B, and when in step S19, the discharge amount per unit area is less than the predetermined value LV5, the heater temperature of the drying device 40 may be lowered during execution of the job PJ.

In the above-described embodiments, when the processings in step S18 and step S19 are omitted and in step S17, the humidity detection unit 53 detects an absolute humidity exceeding the upper limit value B, and when in step S21, the roll diameter is not less than the predetermined value WD6, a force that the force applying unit applies to the medium 99 in the direction approaching the support portion 22 may be intensified. For example, the suction mechanism 30 may be driven to apply a suction force to the medium 99 as a force in the direction approaching the support portion 22, or to intensify the suction force.

In the above-described embodiments, the processings of step S18 and step S21 is omitted and in step S17, the humidity detection unit 53 detects an absolute humidity exceeding an upper limit value B, and when in step S19, the discharge amount per unit area is less than the predetermined value LV5, a force that the force applying unit applies to the medium 99 in the direction approaching the support portion 22 may be intensified. For example, the suction mechanism 30 may be driven to apply a suction force to the medium 99 as a force in the direction approaching the support portion 22, or to intensify the suction force.

In the above-described embodiments, when the processings in step S18 and step S19 are omitted and in step S17, the humidity detection unit 53 detects an absolute humidity exceeding the upper limit value B, and when in step S21, the roll diameter is less than the predetermined value WD6, the winding force may be reduced.

In the above-described embodiments, when the processings in step S18 and step S21 are omitted and in step S17, the humidity detection unit 53 detects an absolute humidity exceeding the upper limit value B, the winding force may be reduced.

When the humidity detection unit 53 detects the absolute humidity A exceeding the upper limit value B, the control unit 70 may raise the heat-set temperature of the preheater 31 in step S22 or S23. By raising the temperature of the preheater 31, the moisture content of the portion of the medium 99 before performing printing is reduced, and the total moisture content of the medium 99 after performing printing is relatively reduced, thus reducing the amount of expansion and contraction of the medium 99 after performing printing, to suppress the occurrence of the wrinkles 99S.

In step S22, the control unit 70 may reduce one or both of the front tension and the back tension, in addition to reducing the winding force the winding unit 17.

When the humidity detection unit 53 detects the absolute humidity AH exceeding the upper limit value B, the control unit 70 may control the gap adjustment mechanism 29 to change the gap between the discharge unit 28 and the support surface 22A to the larger gap side. The control unit 70 control the gap adjustment mechanism 29 to change the gap to a larger value than that at the normal time when the absolute humidity AH falls within the printing environment appropriate region HA. For example, supposing that the designated printing resolution is a second resolution when performing normal printing that is lower than a first resolution when performing high definition printing, the gap is changed to a second gap greater than the first gap being the default value. This allows, even if the wrinkles 99S occur in the medium 99, the large gap to prevent the wrinkles 99S from coming into contact with the nozzle opening surface 28B of the discharge unit 28, making it possible to prevent the printing failure of ink stain due to the rubbing. Note that in view of printing accuracy, it is preferred that, when performing high definition printing, the gap be not changed to the larger gap side.

When the humidity detection unit 53 detects the absolute humidity AH exceeding the upper limit value B, the control unit 70 may change the value of the tension that the tension bar 20 applies to the medium 99 to the smaller tension side. The control unit 70 changes the tension set value of the tension bar 20 to a value less than the normal value when the absolute humidity AH falls within the printing environment appropriate region HA, and controls, in an electrical operational manner, the load of the tension bar 20 based on the set value thus changed.

It may be notified that the absolute humidity AH does not fall within the printing environment appropriate region HA. The control unit 70 may cause the display units 60 and 160 to display a message to the user containing information that the absolute humidity AH does not fall within the printing environment appropriate region HA. Further, the control unit 70 may be configured to perform various automatic controls upon receiving an operation signal of OK due to an operation on the operation units 74 and 170 in response to an inquiry that the user performs automatic control.

When performing the automatic control, the parameters may be brought closer to the target value in a stepwise fashion. That is, a control may be performed in which the control parameters are brought closer to the target value in a stepwise fashion until the absolute humidity falls within the printing environment inappropriate region HA.

The suction mechanism 30 may be configured to operate to cause the medium 99 to be suctioned to the support surface 22A only in a period in which the carriage 27 scans to perform a one-pass amount of printing on the medium 99, and configured not to apply negative pressure through the suction port 35 during the period of transporting the medium 99.

A dehumidification unit may be provided inside the housing 12. The dehumidification unit includes a dehumidification driver and a reservoir section, and the water generated by the dehumidification of the dehumidification driver is retained in the reservoir section. The dehumidification driver of any scheme may be used, such as compressor scheme, desiccant scheme, Pelter's scheme using an electronic cooling element (Peltier element), electrolysis scheme for performing dehumidification accompanying electrolysis of moisture using a solid polymeric electrolyte.

A humidity adjustment unit that has both dehumidification function and humidification function may be provided. In this case, the driver may be provided with a dehumidification driver and a humidification driver separately, or may include one driver that has both dehumidification function and humidification function. In the case of the latter, the electrolysis scheme is used for the driver, for example. Note that examples of the moisture used for the humidification include highly humid air generated by the dehumidification, or highly humid air in the space above the water surface inside the reservoir section, without being limited to water.

The drying device 40 may be configured to only have an air blowing function for drying the medium 99 by an air blown from the fan 45, without including the heater tube 41. Further, the liquid discharge apparatus 11 may be devoid of the drying device 40 and configured to perform drying by the afterheater 33. In these cases, the heater temperature of the afterheater 33 as one example of the heating unit may be lowered in step S20.

The liquid discharge apparatus 11 may transport the medium 99 after performing printing to another apparatus provided with a winding device. In addition, the liquid discharge apparatus 11 may be devoid of the feeding unit 15, and configured to include the discharge unit 28 configured to discharge a liquid onto the medium 99 fed from the feeding unit 15 provided in another apparatus.

The transport path is not limited to a trapezoidal transport path in a side view, and may have any path shape such as an entirely flat transport path that extends horizontally.

The medium 99 is not limited to a paper, and may be a film or sheet made of synthetic resin, a cloth, a nonwoven fabric, a laminate sheet, or the like.

The liquid discharge apparatus 11 may be a complex device having a scanner function and a copy function, in addition to the printing function.

Hereinafter, technical concepts recognized from the above-described embodiments and modifications will be described along with the advantageous effects.

A liquid discharge apparatus includes a transport unit configured to transport a medium, a discharge unit configured to discharge a liquid to the medium, a housing including therein the discharge unit, and a humidifying unit configured to humidify an interior of the housing, and a humidity detection unit configured to detect a humidity, wherein when the humidity detection unit detected a humidity less than a first predetermined value, the interior of the housing is humidified by the humidifying unit during transport by the transport unit or during discharge by the discharge unit.

According to the above configuration, when the humidity detection unit detects a humidity less than the first predetermined value, the interior of the housing is humidified by the humidifying unit during transport of the transport unit or during discharge of the discharge unit. This makes it possible to suppress the clogging in the discharge unit due to the foreign substances such as dust and fluff that are easily suspended in the air when the humidity is low, which is less than the first predetermined value. Thus, even when the humidity falls below a suitable range, the occurrence of clogging in the discharge unit, which is the failure cause of disqualifying the products, is suppressed.

In the above-described liquid discharge apparatus, when the transport amount of the medium transported by the transport unit is not less than a second predetermined value, until a job executed by the discharge unit and the transport unit is completed after the humidity detection unit detects a humidity less than the first predetermined value, the interior of the housing may be humidified by the humidifying unit, and when the transport amount is less than the second predetermined value, humidification may not be performed.

According to the above configuration, when the transport amount of the medium transported by the transport unit is not less than the second predetermined value until the job executed by the discharge unit and the transport unit is completed after the humidity detection unit detects a humidity less than the first predetermined value, the interior of the housing is humidified by the humidifying unit, while when the transport amount is less than the second predetermined value, the interior of the housing is not humidified by the humidifying unit. When the transport amount of the medium until the job is completed is long, which is not less than the second predetermined value, the interior of the housing is humidified to suppress the occurrence of clogging in the discharge unit. Further, when the transport amount of the medium until the job is completed is less than the second predetermined value, the job is completed before the occurrence of clogging in the discharge unit, thus the interior of the housing is not unnecessarily humidified. This avoids the medium to which the liquid is discharged from possibly becoming less prone to drying when the interior of the housing is unnecessarily humidified.

In the above-described liquid discharge apparatus, when the transport amount of the medium transported by the transport unit is less than the second predetermined value, until the job is completed after the humidity detection unit detects a humidity less than the first predetermined value, a timing at which a discharge maintenance operation of the discharge unit is executed may be changed to before a start of the job or after a termination of the job.

According to the above configuration, when the transport amount of the medium transported by the transport unit is less than the second predetermined value, until the job is completed after the humidity detection unit detects a humidity less than the first predetermined value, the time to execute the discharge maintenance operation of the discharge unit is changed to before the start of the job or after completion of the job. Thus, even in an environment where the humidity is less than the first predetermined value and the foreign substances such as dust and fluff are easily suspended in the air, the advancing of the time to execute the discharge maintenance operation makes it possible to suppress the occurrence of nozzle clogging in the discharge unit.

In the above-described liquid discharge apparatus, when a liquid amount per unit area of the liquid discharged to the medium from the discharge unit is less than a third predetermined value at the time when the humidity detection unit detects a humidity less than the first predetermined value, the interior of the housing may be humidified by the humidifying unit, while when the liquid amount per unit area is not less than the third predetermined value, humidification may not be performed.

According to the above configuration, in the interior of the housing, the liquid discharged to the medium evaporates to increase the humidity inside the housing. When the liquid amount per unit area of the liquid is small, which is less than the predetermined value LV3 at the time when the humidity detection unit detects a humidity less than the first predetermined value, the interior of the housing is humidified to a small degree even by the evaporation of the liquid. Thus, the interior of the housing is humidified by the humidifying unit. While when the liquid amount per unit area of the liquid is large, which is not less than the third predetermined value, the interior of the housing is humidified to a large degree by the evaporation of the liquid. Thus, humidification of the interior of the housing by the humidifying unit is not performed. Thus, the nozzle clogging in the discharge unit can be suppressed, as well as the medium can be suppressed from becoming less prone to drying due to the interior of the housing being unnecessarily humidified.

A liquid discharge apparatus includes a transport unit configured to transport a medium a discharge unit configured to discharge a liquid onto the medium, a support portion configured to support a portion of the medium, the liquid being discharged from the discharge unit onto the portion of the medium, a housing including therein the discharge unit, a heating unit configured to heat the medium onto which the liquid is discharged from the discharge unit, and a humidity detection unit configured to detect a humidity, wherein when the humidity detection unit detected a humidity exceeding a fourth predetermined value and when a liquid amount per unit area of the liquid discharged from the discharge unit is less than a fifth predetermined value, the temperature of the heating unit is lowered during transport by the transport unit or during discharge by the discharge unit.

According to the above configuration, even when the humidity exceeds the fourth predetermined value, the liquid adhering to the medium is easily dried when the liquid amount per unit area of the liquid discharged to the medium is small, which is less than the fifth predetermined value, which may cause the medium to contract due to the heat of the heating unit, resulting in the occurrence of wrinkles. The lowering of the temperature of the heating unit makes it possible to suppress a contraction of the medium due to the heat, and to suppress the occurrence of wrinkles.

The above-described liquid discharge apparatus may further include a winding unit configured to wind the medium, onto which a liquid is discharged from the discharge unit, in a rolled form, and a force applying unit configured to apply, in a direction approaching the support portion, a force to a portion of the medium, which is supported by the support portion, wherein when a diameter of the medium in a rolled from is not less than a sixth predetermined value at the time when the humidity detection unit detects a humidity exceeding the fourth predetermined value, the force applied to the medium in the direction of approximating the support portion may be increased. Note that the force applying unit "increase a force to apply" includes a case where the force is applied from a state where no force is applied, and a case where the force applied is changed to a greater force.

According to the above configuration, when the diameter of the medium in a rolled form is not less than the sixth predetermined value at the time when the humidity detection unit detects a humidity exceeding the fourth predetermined value, the force applied to the medium in the direction approximating the medium to the support portion is intensified. Reducing the tension exerted on the medium makes it possible to suppress the occurrence of wrinkles and floating. However, when the diameter of the medium in a rolled form is large, which is not less than the sixth predetermined value, reducing the tension exerted on the medium is unfavorable in that the lateral displacement of the medium in a rolled from is facilitated in exchange with the suppression of the wrinkles. Then, the force applied to a portion of the medium, which is supported by the support portion, in the direction approximating the medium 99 to the support portion is intensified to suppress the wrinkles and floating of the medium.

The liquid discharge apparatus may further include a winding unit configured to wind the medium, onto which a liquid is discharged from the discharge unit, in a rolled form, wherein when a diameter of the medium in a rolled form is less than a sixth predetermined value at the time when the humidity detection unit detects a humidity exceeding the fourth predetermined value, a winding force applied to the medium by the winding unit may be weakened.

According to the above configuration, even when the humidity exceeds the fourth predetermined value, the medium in a rolled form is less prone to cause the lateral displacement to occur when the diameter of the medium is small, which is less than the sixth predetermined value, which does not necessarily need to enhance the tension to suppress the lateral displacement. Thus, the winding force when the winding unit winds the medium is weakened. Thus, the tension applied to the medium is suppressed to a small degree, which prevents the wrinkles from occurring in the medium.

A method for controlling a liquid discharge apparatus is a method for controlling the liquid discharge apparatus including a transport unit configured to transport a medium, a discharge unit configured to discharge a liquid onto the medium, a housing including therein the discharge unit, a humidifying unit configured to humidify an interior of the housing, and a humidity detection unit configured to detect a humidity, the method including a humidity detection step for detecting a humidity, and a humidification step for, when the humidity detection unit detected a humidity less than a first predetermined value, humidifying the interior of the housing by the humidifying unit during transport of the transport unit or during discharge of the discharge unit. According to the above configuration, the same advantageous effect as in the above-described liquid discharge apparatus is achieved.

A method for controlling a liquid discharging device is a method for controlling the liquid discharge apparatus including a transport unit configured to transport a medium, a discharge unit configured to discharge a liquid onto the medium, a housing including therein the discharge unit, a heating unit configured to heat the medium to which the liquid is discharged from the discharge unit, and a humidity detection unit configured to detect a humidity, the method including a first determination step for determining whether the humidity detection unit detected a humidity exceeding a fourth predetermined value, a second determination step for determining whether a liquid amount per unit area of the liquid discharged from the discharge unit is less than a fifth predetermined value, and a heating control step for, when the humidity detection unit detected a humidity exceeding the fourth predetermined value and when the liquid amount per unit area of the liquid discharged from the discharge unit is less than the fifth predetermined value, lowering a temperature of the heating unit during transport by the transport unit or during discharge by the discharge unit. According to the above configuration, the same advantageous effect as in the above-described liquid discharge apparatus is achieved.

What is claimed is:

1. A liquid discharge apparatus comprising:

a transport unit configured to transport a medium;

a discharge unit configured to discharge a liquid onto the medium;

a housing including therein the discharge unit;

a humidifying unit configured to humidify an interior of the housing; and a humidity detection unit configured to detect a humidity, wherein when the humidity detection unit detects a humidity less than a first predetermined value, the interior of the housing is humidified by the humidifying unit during transport by the transport unit or during discharge by the discharge unit, wherein when a transport amount of the medium transported by the transport unit is not less than a second predetermined value until a job executed by the discharge unit and the transport unit is completed after the humidity detection unit detects a humidity less than the first predetermined value, the interior of the housing is humidified by the humidifying unit, and when the transport amount is less than the second predetermined value, humidification is not performed.

2. The liquid discharge apparatus according to claim 1 wherein when the transport amount of the medium transported by the transport unit is less than the second predetermined value, until the job is completed after the humidity detection unit detects a humidity less than the first predetermined value, a timing, at which a discharge maintenance operation of the discharge unit is executed, is changed to before a start of the job or after a completion of the job.

3. The liquid discharge apparatus according to claim 1, wherein when a liquid amount per unit area of the liquid discharged to the medium from the discharge unit is less than a third predetermined value at a time when the humidity detection unit detects a humidity less than the first predetermined value, the interior of the housing is humidified by the humidifying unit, while when the liquid amount per unit area is not less than the third predetermined value, humidification is not performed.

4. A liquid discharge apparatus comprising:

a transport unit configured to transport a medium;

a discharge unit configured to discharge a liquid onto the medium;

a support portion configured to support a portion of the medium, the liquid being discharged from the discharge unit onto the portion of the medium;

a housing including therein the discharge unit;

a heating unit configured to heat the medium onto which the liquid is discharged from the discharge unit; and a humidity detection unit configured to detect a humidity, wherein when the humidity detection unit detects a humidity exceeding a first predetermined value and when a liquid amount per unit area of the liquid discharged from the discharge unit is less than a second predetermined value, the temperature of the heating unit is lowered during transport by the transport unit or during discharge by the discharge unit, wherein when a transport amount of the medium transported by the transport unit is not less than a second predetermined value until a job executed by the discharge unit and the transport unit is completed after the humidity detection unit detects a humidity less than the first predetermined value, the interior of the housing is humidified by the humidifying unit, and when the transport amount is less than the second predetermined value, humidification is not performed.

5. The liquid discharge apparatus according to claim 4, further comprising:

a winding unit configured to wind the medium, onto which a liquid is discharged from the discharge unit, in a rolled form; and a force applying unit configured to apply, in a direction approaching the support portion, a force to a portion of the medium supported by the support portion, wherein when a diameter of the medium in a rolled from is not less than a third predetermined value at a time when the humidity detection unit detects a humidity exceeding the first predetermined value, the force applied to the medium in a direction approximating the support portion is increased.

6. The liquid discharge apparatus according to claim 4, further comprising a winding unit configured to wind the medium, onto which a liquid is discharged from the discharge unit, in a rolled form, wherein when a diameter of the medium in a rolled form is less than a third predetermined value at a time when the humidity detection unit detects a humidity exceeding the first predetermined value, a winding force of the winding unit for winding the medium is weakened.

7. A method for controlling a liquid discharge apparatus including a transport unit configured to transport a medium, a discharge unit configured to discharge a liquid onto the medium, a housing including therein the discharge unit, a humidifying unit configured to humidify an interior of the housing, and a humidity detection unit configured to detect a humidity, the method comprising:

a humidity detection step for detecting a humidity; and a humidification step for humidifying the interior of the housing by the humidifying unit:

when the humidity detection unit detects a humidity less than a first predetermined value during transport by the transport unit or during discharge by the discharge unit, and when a transport amount of the medium transported by the transport unit is not less than a second predetermined value until a job executed by the discharge unit and the transport unit is completed after the humidity detection unit detects a humidity less than the first predetermined value, and when the transport amount is less than the second predetermined value, humidification is not performed.

8. A method for controlling a liquid discharge apparatus including a transport unit configured to transport a medium, a discharge unit configured to discharge a liquid onto the medium, a housing including therein the discharge unit, a heating unit configured to heat the medium onto which the liquid is discharged from the discharge unit, and a humidity detection unit configured to detect a humidity, the method comprising:

a first determination step for determining whether the humidity detection unit detects a humidity exceeding a first predetermined value;

a second determination step for determining whether a liquid amount per unit area of the liquid discharged from the discharge unit is less than a second predetermined value;

a heating control step for, when the humidity detection unit detects a humidity exceeding the first predetermined value and when the liquid amount per unit area of the liquid discharged from the discharge unit is less than the fifth predetermined value, lowering a temperature of the heating unit during transport by the transport unit or during discharge by the discharge unit; and a humidification step for humidifying the interior of the housing by the humidifying unit when the humidity detection unit detects the humidity less than a first predetermined value during transport by the transport unit or during discharge by the discharge unit, and when a transport amount of the medium transported by the transport unit is not less than a second predetermined value until a job executed by the discharge unit and the transport unit is completed after the humidity detection unit detects a humidity less than the first predetermined value, and when the transport amount is less than the second predetermined value, humidification is not performed.

* * * * *